US012172862B2

(12) United States Patent
Suzuki et al.

(10) Patent No.: US 12,172,862 B2
(45) Date of Patent: Dec. 24, 2024

(54) SHEET FEEDING APPARATUS AND IMAGE FORMING APPARATUS

(71) Applicant: CANON KABUSHIKI KAISHA, Tokyo (JP)

(72) Inventors: Masato Suzuki, Shizuoka (JP); Kenichirou Isobe, Kanagawa (JP); Eiji Wakiyama, Kanagawa (JP); Takashi Yano, Shizuoka (JP); Hidehiro Ushiozu, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 17/988,037

(22) Filed: Nov. 16, 2022

(65) Prior Publication Data

US 2023/0159291 A1 May 25, 2023

(30) Foreign Application Priority Data

Nov. 22, 2021 (JP) ..... 2021-189171

(51) Int. Cl.

| | |
|---|---|
| ***B65H 7/20*** | (2006.01) |
| ***B65H 1/14*** | (2006.01) |
| ***B65H 1/26*** | (2006.01) |
| ***B65H 3/06*** | (2006.01) |
| ***B65H 7/02*** | (2006.01) |

(52) U.S. Cl.

CPC ..... *B65H 7/20* (2013.01); *B65H 1/14* (2013.01); *B65H 1/266* (2013.01); *B65H 3/06* (2013.01); *B65H 7/02* (2013.01); *B65H 2801/03* (2013.01)

(58) Field of Classification Search

CPC ..... B65H 7/02; B65H 7/20; B65H 2801/03; B65H 1/14; B65H 1/26; B65H 1/266; B65H 1/025; B65H 2402/441; B65H 3/06; B65H 3/0684; G03G 21/16; B41J 29/38

See application file for complete search history.

(56) References Cited

U.S. PATENT DOCUMENTS

| | | | |
|---|---|---|---|
| 5,493,380 | A | 2/1996 | Saitou |
| 5,860,051 | A | 1/1999 | Goto |
| 5,862,435 | A | 1/1999 | Suzumi |
| 5,920,757 | A | 7/1999 | Izawa |

(Continued)

FOREIGN PATENT DOCUMENTS

| | | | |
|---|---|---|---|
| JP | 2001-222204 | A | 8/2001 |
| JP | 2006-163304 | A | 6/2006 |

(Continued)

*Primary Examiner* — Leslie A Nicholson, III
(74) *Attorney, Agent, or Firm* — Venable LLP

(57) ABSTRACT

A sheet feeding apparatus includes a stacking unit including a plate, a feeding unit including a roller, a holder including a detected member, a drive unit and a controller. The detected member is positioned in a first position where the detected member is not detected by a detector in a case that the feeding unit is new, and is moved from the first position to a second position where the detected member is projected so as to be detected by the detector when the new feeding unit is mounted on the holder and the roller is driven. The controller controls the drive unit to perform up-and-down operation of the plate so that the plate is set to a feedable state of the sheet in a case that the feeding unit is mounted, and determines whether or not the feeding unit is new based on a detection result of the detector.

14 Claims, 10 Drawing Sheets

(a)

(b)

(56) References Cited

U.S. PATENT DOCUMENTS

| | | | | |
|---|---|---|---|---|
| 5,991,555 | A | 11/1999 | Suzumi | |
| 6,131,010 | A | 10/2000 | Kume | |
| 6,185,383 | B1 | 2/2001 | Kanari | |
| 6,260,840 | B1 | 7/2001 | Suga | |
| 6,263,172 | B1 | 7/2001 | Suzuki | |
| 6,298,202 | B1 | 10/2001 | Fushiya et al. | |
| 6,298,213 | B1 | 10/2001 | Miyamoto | |
| 6,336,009 | B1 | 1/2002 | Suzumi | |
| 6,382,622 | B1 | 5/2002 | Takada | |
| 6,456,819 | B1 | 9/2002 | Abe | |
| 6,467,767 | B2 | 10/2002 | Yano | |
| 6,493,521 | B2 | 12/2002 | Miyamoto | |
| 6,505,027 | B2 | 1/2003 | Takeuchi | |
| 6,527,267 | B1 | 3/2003 | Kuwata | |
| 6,543,758 | B2 | 4/2003 | Imura | |
| 6,564,033 | B2 | 5/2003 | Zhou | |
| 6,580,883 | B2 | 6/2003 | Suzumi | |
| 6,597,888 | B1 | 7/2003 | Abe | |
| 6,643,480 | B2 | 11/2003 | Kuwata | |
| 6,661,995 | B2 | 12/2003 | Isobe | |
| 6,674,978 | B1 | 1/2004 | Suzuki | |
| 6,701,102 | B2 | 3/2004 | Hasegawa | |
| 6,704,537 | B2 | 3/2004 | Takeuchi | |
| 6,763,205 | B2 | 7/2004 | Izawa | |
| 6,775,509 | B2 | 8/2004 | Shida | |
| 6,782,230 | B2 | 8/2004 | Yaomin | |
| 6,792,240 | B2 | 9/2004 | Shida | |
| 6,826,383 | B2 | 11/2004 | Yano | |
| 6,912,044 | B2 | 6/2005 | Sekiyama | |
| 6,925,271 | B2 | 8/2005 | Suzuki | |
| 6,937,837 | B2 | 8/2005 | Takeuchi | |
| 6,947,699 | B2 | 9/2005 | Suzuki | |
| 6,965,742 | B2 | 11/2005 | Miyamoto | |
| 6,973,285 | B2 | 12/2005 | Sekiyama | |
| 6,988,727 | B2 | 1/2006 | Yano | |
| 6,998,589 | B2 | 2/2006 | Yano | |
| 7,810,811 | B2 | 10/2010 | Suzuki | |
| 7,967,287 | B2 | 6/2011 | Hamasaki | |
| 7,971,868 | B2 | 7/2011 | Matsushima | |
| 8,215,637 | B2 | 7/2012 | Yano | |
| 8,317,193 | B2 | 11/2012 | Yano | |
| 8,761,657 | B2 | 6/2014 | Suzuki | |
| 8,991,824 | B2 | 3/2015 | Suzuki | |
| 9,033,334 | B2 | 5/2015 | Yano | |
| 9,359,159 | B2 | 6/2016 | Noda | |
| 9,522,794 | B2 * | 12/2016 | Osada | B65H 7/02 |
| 9,880,505 | B2 * | 1/2018 | Matsumoto | B65H 29/22 |
| 10,394,178 | B2 | 8/2019 | Fujinuma | |
| 10,399,805 | B2 | 9/2019 | Shiina | |
| 10,452,024 | B2 | 10/2019 | Nakamura et al. | |
| 10,486,921 | B2 | 11/2019 | Nakiyama | |
| 10,584,006 | B2 * | 3/2020 | Suzuki | B65H 5/062 |
| 10,611,587 | B2 | 4/2020 | Kato | |
| 11,124,378 | B2 | 9/2021 | Kasuya | |
| 11,199,801 | B2 | 12/2021 | Isobe | |
| 11,203,496 | B2 * | 12/2021 | Tsuda | B65H 5/062 |
| 11,254,536 | B2 | 2/2022 | Noda | |
| 11,261,051 | B2 | 3/2022 | Isobe | |
| 11,390,476 | B2 | 7/2022 | Suzuki | |
| 2008/0180764 | A1 | 7/2008 | Wakiyama | |
| 2011/0221121 | A1 | 9/2011 | Hamasaki | |
| 2018/0239295 | A1 | 8/2018 | Fujimuma | |
| 2019/0179261 | A1 | 6/2019 | Nakamura et al. | |
| 2022/0144577 | A1 | 5/2022 | Isobe | |

FOREIGN PATENT DOCUMENTS

| | | | |
|---|---|---|---|
| JP | 2017-007758 | A | 1/2017 |
| JP | 2018-135171 | A | 8/2018 |
| JP | 2019-105737 | A | 6/2019 |

* cited by examiner (b)

(a)

(b)

(a)

(b)

(a)

(b)

(a)

SHEET FEEDING APPARATUS AND IMAGE FORMING APPARATUS

FIELD OF THE INVENTION AND RELATED ART

The present invention relates to a sheet feeding apparatus and an image forming apparatus which is provided with a sheet feeding apparatus.

Conventionally, in the image forming apparatus such as a copier and a printer, a feeding mechanism which separates and feeds paper which is a recording material which is stacked in a feeding portion and a conveying mechanism which conveys paper to an image forming portion are provided. For example, in the feeding mechanism, a configuration that a rubber roller is applied to a feeding roller which feeds paper and the paper is fed one sheet by one sheet is generally used. A feeding roller is made of soft and easily worn rubber in order to feed various types of media, and therefore wear on a surface of the feeding roller due to repeated feeds of paper is significant. Further, various factors, such as paper dust adhesion to the feeding roller and deterioration of rubber, degrade paper feeding performance of the feeding roller. In recent years, a main assembly of an image forming apparatus has a long life, and a feeding roller which is subject to severe wear and deterioration is configured to be easily replaceable, so a longer life of the main assembly of the image forming apparatus is supported on an assumption of replacement.

The replaceable feeding roller is replaced with a new one by a user or a service person as a consumable article. And various detection methods are proposed so that the main assembly of the image forming apparatus detects a timing of replacement of the feeding roller. For example, in a method disclosed in Japanese Laid-Open Patent Application (JP-A) 2017-007758, a time from a start of rotation of the feeding roller until paper is conveyed to a sensor which is provided downstream of a conveying passage and a delay in conveying the paper is detected based on the measured time. And the main assembly of the image forming apparatus informs a user, etc. that the feeding roller needs to be replaced when an incidence rate of the delay in conveying the paper which is detected exceeds a threshold value. Further, when the main assembly of the image forming apparatus determines that the feeding roller needs to be replaced, it urges the user or the service person to replace the feeding roller in order to prevent conveying failure.

And when the feeding roller is replaced by the user or the service person, the image forming apparatus needs to detect that the feeding roller is replaced with a new one and stop a notification operation which urges the user or the service person to replace the feeding roller. Therefore, the user or the service person performs a reset operation, etc. to set the image forming apparatus in a state that the feeding roller is completed to be replaced via an operation panel of the image forming apparatus, etc. The reset operation which is described above is an operation which is performed by an operator such as a user or a service person. Therefore, it is assumed that after the operator replaces the feeding roller with a new one, the operator may forget to perform a reset operation which sets completion of replacement of the feeding roller or to check an operation. In such a case, since the reset operation is not performed, the image forming apparatus determines that a state in which the feeding roller still needs the replacement of the feeding roller is continued and continues to inform the user or the service person that the feeding roller should be replaced.

Further, in an image forming apparatus which includes a plurality of sheet feeding ports, it is assumed that an operator may accidentally perform a reset operation to set completion of replacement of the feeding roller of a sheet feeding port which has not been replaced. As a result, the image forming apparatus is not able to correctly detect an actual state of use of the feeding rollers. Therefore, it is desired that the image forming apparatus is able to detect automatically and correctly without any manual work that the feeding roller has been replaced with a new one without resorting to the reset operation by the user or the service person.

SUMMARY OF THE INVENTION

In response to such situation, an object of the present invention is to automatically detect that a feeding roller has been replaced with a new one. In order to solve the problems which are described above, the present invention is provided with following configurations.

A sheet feeding apparatus comprising, a stacking unit provided with a stacking plate on which a sheet is stacked and capable of performing up-and-down operation, a feeding unit provided with a feed roller configured to feed the sheet, a rotatable supporting member configured to support the feed roller, and a detected member provided on the supporting member, a holding unit provided with a detecting device configured to detect the detected member, provided above the stacking unit, and configured to dismountably hold the feeding unit, a drive unit configured to cause the stacking plate to perform the up-and-down operation, and a control unit configured to control the drive unit, wherein the detected member is positioned in a first position where the detected member is not detected by the detecting device in a case that the feeding unit is new, and is moved from the first position to a second position where the detected member is projected so as to be detected by the detecting device when the new feeding unit is mounted on the holding unit and the feed roller is driven, wherein the control unit controls the drive unit to perform the up-and-down operation of the stacking plate so that the stacking plate is set to a feedable state of the sheet stacked on the stacking plate in a case that the feeding unit is mounted, and determines whether or not the feeding unit is new based on a detection result of the detecting device.

Further features of the present invention will become apparent from the following description of exemplary embodiments with reference to the attached drawings.

DESCRIPTION OF THE EMBODIMENTS

In the following, embodiments of the present invention will be specifically described with reference to Figures.

First Embodiment

[Image Forming Apparatus]

Figure 1:
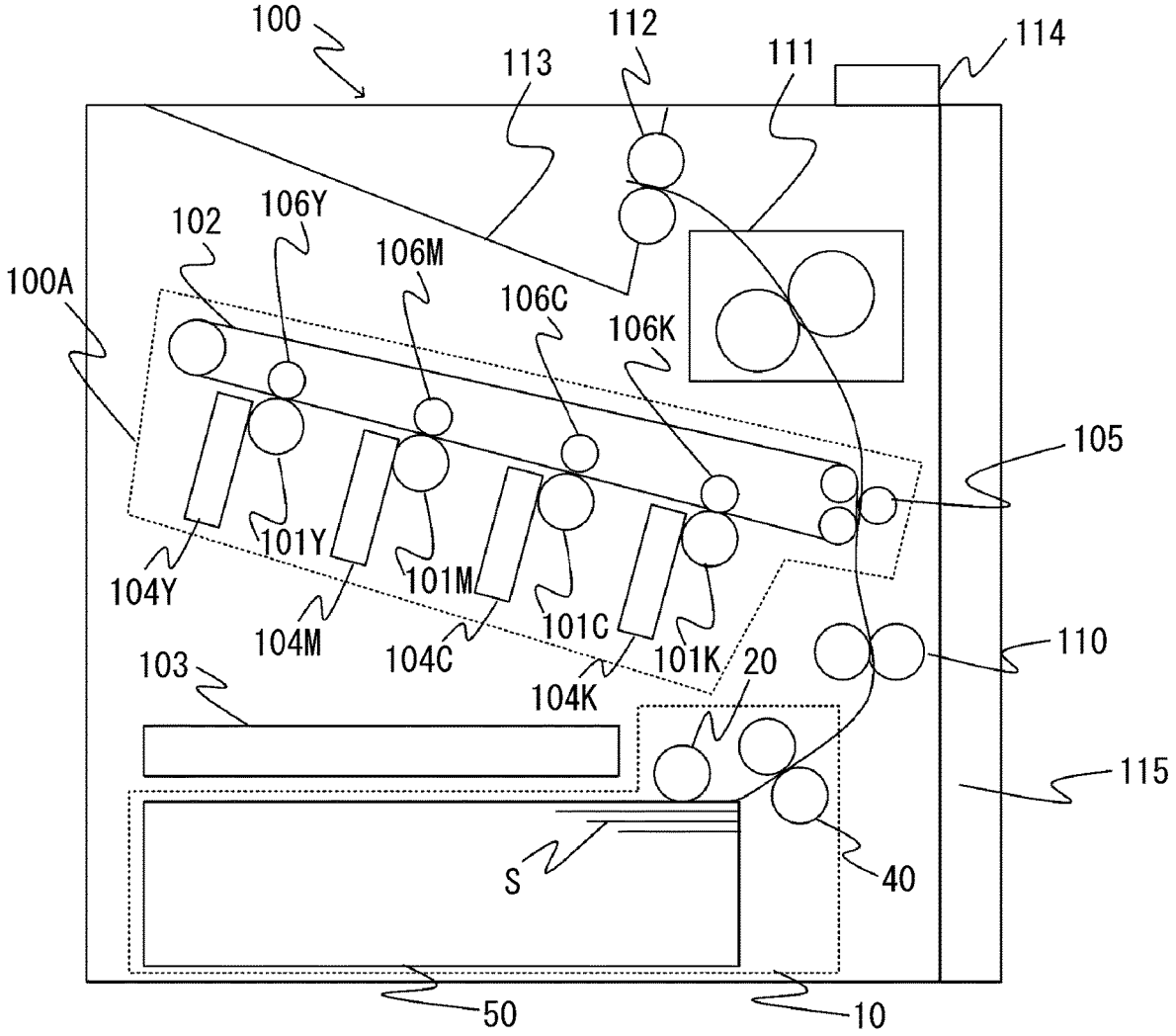
FIG. 1 is a schematic sectional view showing a configuration of an image forming apparatus according to a first embodiment and a second embodiment of the present invention.

FIG. 1 is a schematic sectional view showing a configuration of an image forming apparatus which is provided with a sheet feeding apparatus according to a first embodiment to which the present invention is applied. Here, an electrophotographic color laser printer (hereinafter referred to as a printer 100) as an image forming apparatus will be described as an example. The printer 100 uses an electrophotographic method, however, the present invention is not limited to an electrophotographic printer and it is also possible to apply to an inkjet printer, for example. Incidentally, in the embodiment, a part of the printer 100 is configured of the sheet feeding apparatus 10 which feeds a sheet which is a recording material, however, a sheet feeding apparatus may be a feeding deck which is capable of accommodating a plurality of sheets in large quantities which is mounted on the printer 100 as an optional device.

The printer 100 is provided with an image forming portion 100A which forms a toner image which is transferred onto a sheet and the sheet feeding apparatus 10 which feeds a sheet to the image forming portion 100A which are each surrounded by a dotted line in FIG. 1. The image forming portion 100A is provided with four photosensitive drums 101Y, 101M, 101C and 101K, in which toner images of four colors, yellow (Y), magenta (M), cyan (C) and black (K) are formed respectively. Incidentally, in FIG. 1, each of configurations of the image forming portions which form toner images of respective colors is same, and Y, M, C and K at ends of reference numerals mean members which perform image forming of the toner colors yellow, magenta, cyan and black, respectively. Further, the image forming portion 100A is provided with an endless intermediary transfer belt 102 which is contacted with these four photosensitive drums 101Y, 101M, 101C and 101K and to which each toner image which is formed on each of the photosensitive drums 101Y, 101M, 101C, 10 1K are transferred. Furthermore, the image forming portion 100A is provided with primary transfer rollers 106Y, 106M, 106C and 106K which are disposed to oppose the photosensitive drums 101Y, 101M, 101C and 101K and urge the intermediary transfer belt 102 to the corresponding photosensitive drums 101. When transfer voltage is applied to the primary transfer rollers 106Y, 106M, 106C and 106K from a transfer voltage source (not shown), the toner images on the photosensitive drums 101Y, 101M, 101C and 101K are transferred to the intermediary transfer belt 102. Furthermore, the image forming portion 100A is provided with a secondary transfer roller 105 which transfers the toner image, which is transferred from each of the respective photosensitive drums 101Y, 101M, 101C and 101K to the intermediary transfer belt 102, to the sheet S which is fed from the sheet feeding apparatus 10.

When the image forming portion 100A starts an image forming operation, a light beam according to an image signal is emitted from a laser scanner 103 to the photosensitive drums 101Y, 101M, 101C and 101K whose surfaces are charged at a constant potential. As a result, electrostatic latent images are formed on the photosensitive drums 101Y, 101M, 101C and 101K. And when the electrostatic latent images are developed with the toner which is accommodated in developer cartridges 104Y, 104M, 104C and 104K, toner images which are visible images are formed on the photosensitive drums 101Y, 101M, 101C and 101K. The toner images which are formed on the photosensitive drums 101Y, 101M, 101C and 101K are transferred to the intermediary transfer belt 102 by the primary transfer rollers 106Y, 106M, 106C and 106M. And the toner images on the intermediary transfer belt 102 are conveyed to a secondary transfer portion, which is a nip portion which is formed by abutting the secondary transfer roller 105 with the intermediary transfer belt 102.

On the other hand, in parallel with the image forming operation in the image forming portion 100A which is described above, a sheet S which is stacked in a sheet accommodating unit 50 is fed one by one, by a feeding roller unit 20 and a separating roller unit 40 in the sheet feeding apparatus 10. The sheet S which is fed is conveyed to the secondary transfer portion by a registration roller 110 which corrects for skewness. Incidentally, since it is necessary to align the toner image which is transferred onto the intermediary transfer belt 102 with a position of the sheet S to which the toner image is transferred with respect to the conveying direction, the registration roller 110 preforms a conveying speed control and adjusts a conveying timing of the sheet S. And, in the secondary transfer portion, the toner image on the intermediary transfer belt 102 is transferred to the sheet S by applying a transfer voltage to the secondary transfer roller 105.

The sheet S onto which the toner image is transferred is then conveyed to a fixing portion 111, and the toner image is fixed to the sheet S when the toner image is heated and pressed in a fixing portion 111. And the sheet S to which the toner image is fixed is discharged to a discharge member 113 at the top of the printer 100 by a discharge roller 112.

Incidentally, an operation portion 114, which includes an operation panel to input data, an image forming instruction, etc. and a displaying member which displays information, is provided. Further, on a right side of the printer 100 which is shown in FIG. 1, a right door 115, in which open and close operation is performed when maintenance work such as replacing the feeding roller unit 20 is performed, is provided.

[Sheet Feeding Apparatus]

Figure 2:
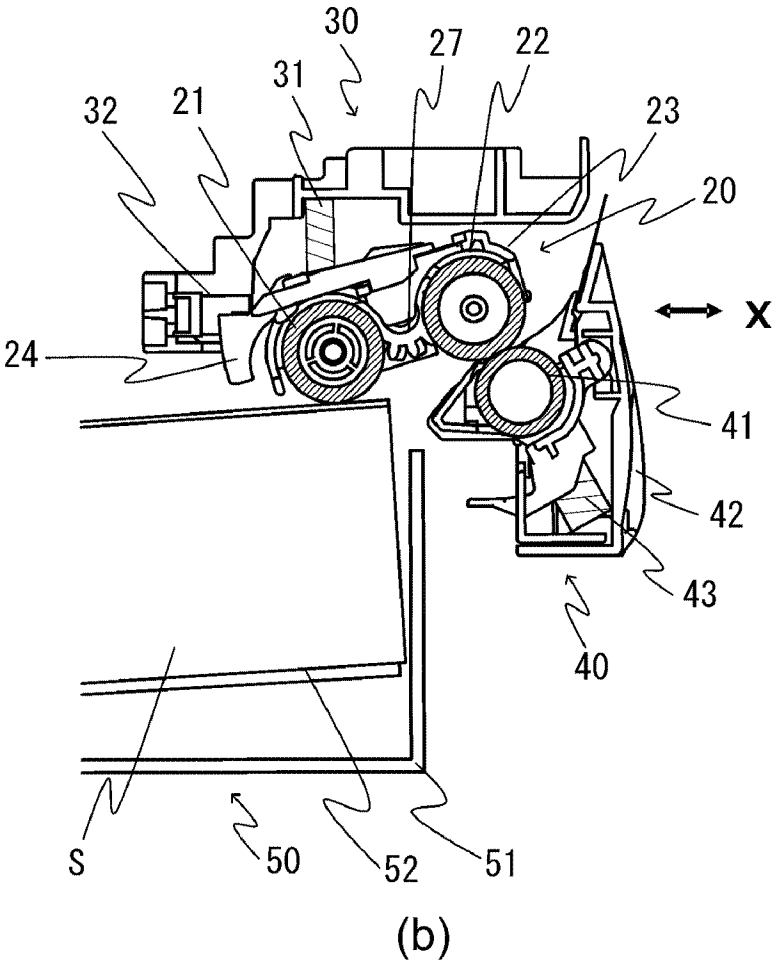
FIG. 2, part (a) and part (b), is a sectional view showing a configuration of a sheet feeding apparatus according to the first embodiment.
Figure 2:
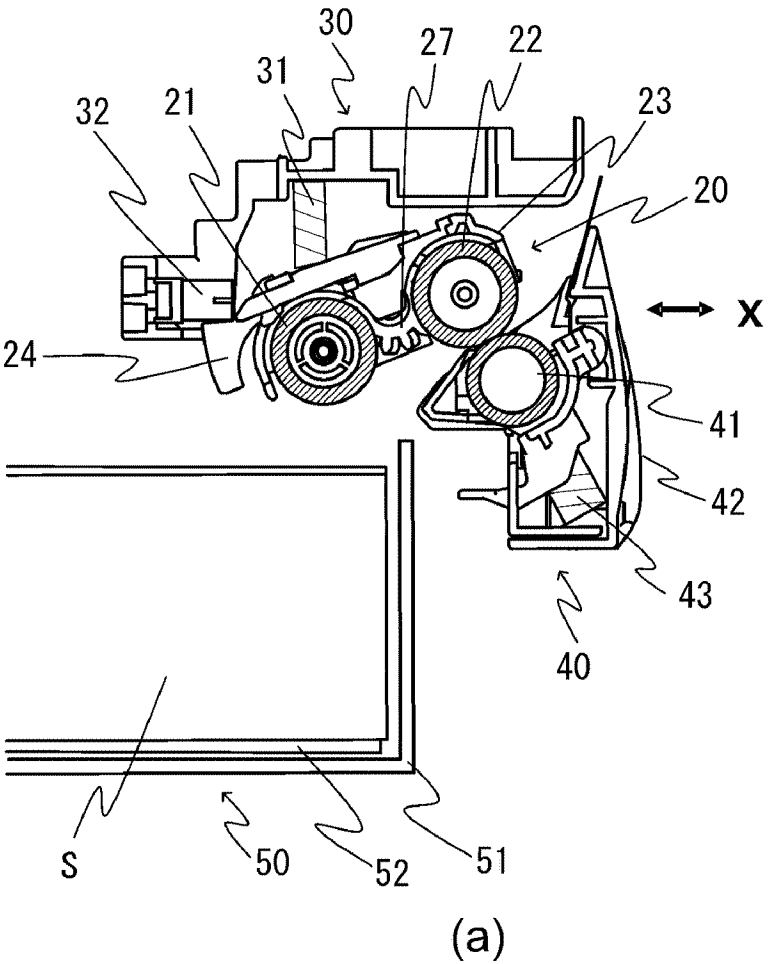

Next, the sheet feeding apparatus 10 to which the present invention is applied will be described. Parts (a) and (b) of FIG. 2 are sectional views showing a configuration of the sheet feeding apparatus 10. Part (a) of FIG. 2 is a diagram showing a state before the sheets S which are stacked in the sheet accommodating unit 50 are lifted up in a direction of the feeding roller unit 20. On the other hand, part (b) of FIG. 2 is a diagram showing a state that the sheets S which are stacked in the sheet accommodating unit 50 are lifted up in the direction of the feeding roller unit 20 and a topmost sheet S is positioned at a feeding start position in which the uppermost sheet S is abutted with a pickup roller 21. The sheet feeding apparatus 10 is configured of the feeding roller unit 20, a feeding roller holding unit 30, the separating roller unit 40, the sheet accommodating unit 50, a feeding drive unit 60 (see FIG. 3) and a lift-up drive unit 70 (see FIG. 3).

(Feeding Roller Unit)

The feeding roller unit 20 (a feeding unit) is a feeding means which feeds the sheet S. The feeding roller unit 20 includes a pickup roller 21 and a feeding roller 22 which are feeding members (feeding rollers) which are made of robber material and a roller holder 23 which is a supporting means which rotatably supports the pickup roller 21 and the feeding roller 22. Further, a detecting flag 24 (a detected member) for detecting a state of the feeding roller unit 20 by a paper surface sensor 32 which will be described below is provided on a left side of the pickup roller 21 in FIG. 2. Furthermore, the feeding drive unit 60 (see FIG. 3), which drives the feeding roller unit 20, rotatably drives the feeding roller 22 and the pickup roller 21. Incidentally, an idler gear 27 will be described below.

(Feeding Roller Holding Unit)

The feeding roller holding unit 30 includes a feeding roller supporting member (not shown) which supports the feeding roller unit 20, a pick spring 31 and the paper surface sensor 32. The feeding roller unit 20 is rotatably mounted on the feeding roller holding unit 30 around the feeding roller supporting member (not shown). Since a center of rotation of the feeding roller 22 is provided at a same axial position with the feeding roller supporting member (not shown), the feeding roller unit 20 is rotatable around the center of rotation of the feeding roller 22 as a rotational axis. When the feeding roller unit 20 is mounted on the feeding roller holding unit 30, the pick spring 31 urges the roller holder 23 in a direction of the sheet S. The paper surface sensor 32 which is a detecting device is a photointerrupter which includes a light emitting portion which emits light and a light receiving portion which receives the light which is emitted from the light emitting portion. The paper surface sensor 32 detects a light shielding state in which the detecting flag 24 of the feeding roller unit 20 shields light from the light emitting portion or a light transmitting state in which the light from the light emitting portion is not shielded, and outputs it to a state determining portion 81 (see FIG. 3) of the control portion 80, which will be described below. For example, in a case that the feeding roller unit 20 is in a state which is shown in part (a) of FIG. 2, the detecting flag 24 is in a state in which light from the light emitting portion of the paper surface sensor 32 is not shielded and the paper surface sensor 32 outputs a light transmitting state (a state that the detecting flag 24 is not detected). On the other hand, in a case that the feeding roller unit 20 is in a state which is shown in part (b) of FIG. 2, the detecting flag 24 is in a state in which the light from the light emitting portion of the paper surface sensor 32 is shielded and the paper surface sensor 32 outputs a light shielding state (a state that the detecting flag 24 is detected).

(Separating Roller Unit)

The separating roller unit 40 includes a separating roller 41 which separates the sheet S one by one, a cover member 42 which holds the separating roller 41 and a separating spring 43. The separating roller 41 is urged in a direction of the feeding roller 22 by the separating spring 43. In a case that a plurality of the sheets S are fed to a nip portion in which the feeding roller 22 is abutted with the separating roller 41 by the pickup roller 21 of the feeding roller unit 20, the separating roller 41 separates the sheet S one by one and conveys the sheet S downstream in a conveying passage.

Incidentally, in the sheet feeding apparatus 10 of the embodiment, the feeding roller unit 20 and the separating roller unit 40 are configured to be replaced easily by a user or a service person. In detail, in a case of replacing the feeding roller unit 20 or the separating roller unit 40, it is possible to remove the separating roller unit 40 and the feeding roller unit 20 which are mounted, by opening the right door 115 (FIG. 1) and pulling out the separating roller unit 40 and the feeding roller unit 20 in a right direction which is indicated by X in the figure. And in a case of mounting the feeding roller unit 20 and the separating roller unit 40, it is possible to mount the feeding roller unit 20 and the separating roller unit 40 by inserting the feeding roller unit 20 and the separating roller unit 40 in a left direction which is indicated by X in the figure. Further, it is possible to detect an open and closed state of the right door 115, which is a door, by a right door sensor 116 (see FIG. 3) which is an open and close detecting device.

(Sheet Accommodating Unit)

The sheet accommodating unit 50 is mountable on and dismountable from the sheet feeding apparatus 10 and includes an accommodating cassette 51 which is possible to accommodate the plurality of sheets S. The accommodating cassette 51 is a stacking unit in which the sheet S is stacked, and includes a stacking plate 52 which lifts the stacked sheet S up and down. The lift-up drive unit 70 (see FIG. 3), which will be described below, transmits drive to a lift-up gear (not shown) which is mounted on the stacking plate 52 and lifts the stacking plate 52 up and down as shown in part (b) of FIG. 2.

[Control Portion of Sheet Feeding Apparatus]

Figure 3:
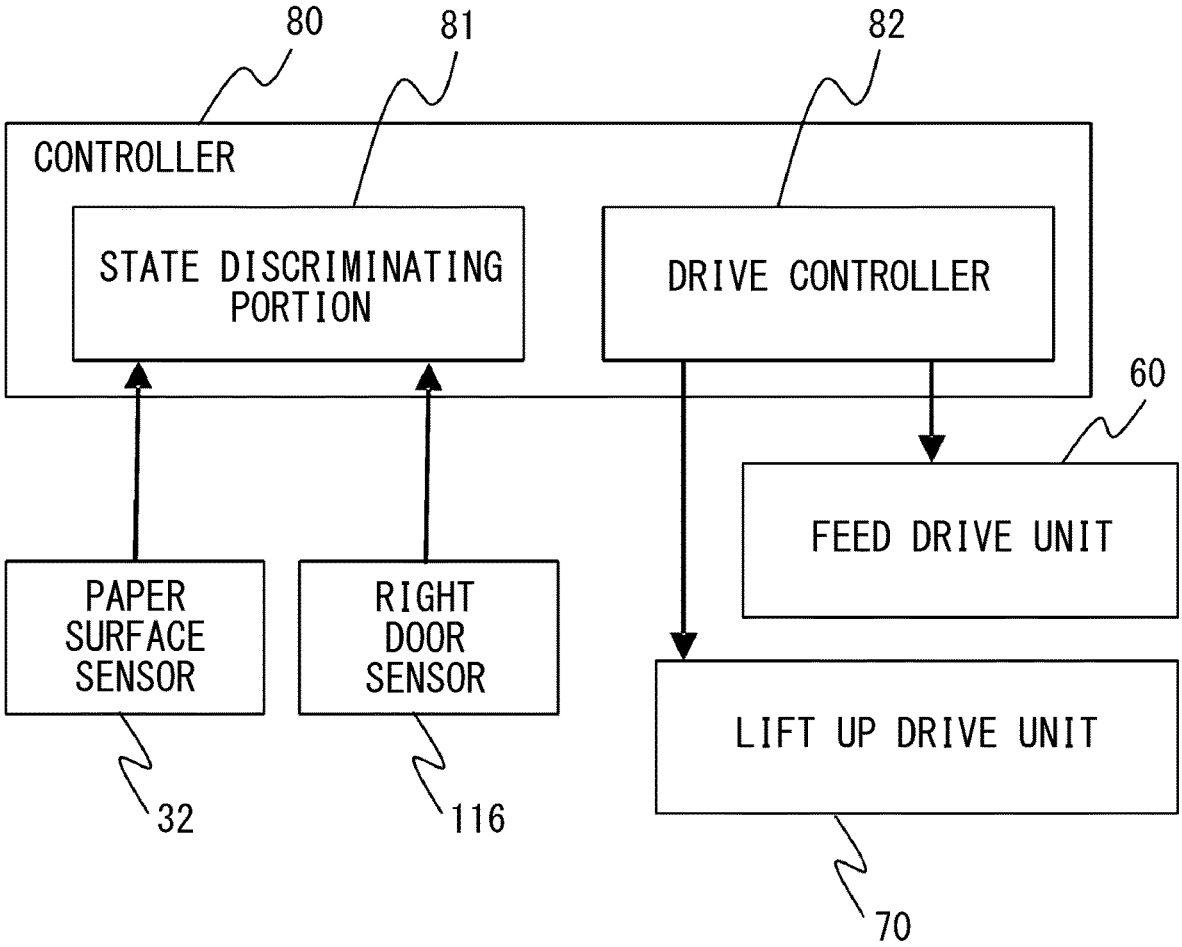
FIG. 3 is a control block diagram of the sheet feeding apparatus according to the first embodiment.

FIG. 3 is a control block diagram showing a constitution of a control portion of the sheet feeding apparatus 10. A control portion 80, which is a control unit which controls the sheet feeding apparatus 10, includes the state determining portion 81, which determines a state based on a signal which is output from each sensors, and a drive control portion 82 which controls a driving unit based on determination of the state determining portion 81 and a timing for feeding the sheet S. The state determining portion 81 determines a state of the feeding roller unit 20 based on a light transmitting state or a light shielding state in which the paper surface sensor 32, which described above, outputs according to a state of the detecting flag 24 of the feeding roller unit 20. Further, the state determining portion 81 determines an open and closed state of the right door 115 based on a detection result of the right door sensor 116 which is described above. The drive control portion 82 controls the feeding drive unit 60, which drives the feeding roller unit 20 which feeds the sheet S and the lift-up drive unit 70 (a drive unit) which lifts the stacking plate 52 up and down on which the sheets S are stacked.

[Sheet Feeding Operation]

Next, an operation, in which the sheet feeding apparatus 10 feeds the sheet S which is accommodated in the sheet accommodating unit 50 to a conveying passage toward the secondary transfer portion of the image forming portion 100A of the printer 100, will be described. The control portion 80 instructs the drive control portion 82 to drive the lift-up drive unit 70. The drive control portion 82 drives the lift-up drive unit 70 and lifts up the stacking plate 52 of the sheet accommodating unit 50. Thus, the sheet S, which is stacked on the stacking plate 52 (on a stacking plate), is lifted up in a direction toward the pickup roller 21 and the pickup roller 21 contacts the uppermost sheet S. At this time, the pickup roller 21 is pressed downward from the pick spring 31 via the roller holder 23 in FIG. 2. Further, the roller holder 23 is rotatably held around a rotational axis of the feeding roller 22. Therefore, against a pressing force of the pick spring 31, the sheet S which is stacked on the stacking plate 52 is lifted up, and the roller holder 23 which supports the pickup roller 21 is also lifted up by pressing force from the sheet S. And the detecting flag 24 which is mounted on the roller holder 23 is also lifted up in an upward direction in FIG. 2, and the detecting flag 24 is lifted up is lifted up to a position in which light which is emitted from the light emitting portion of the paper surface sensor 32 is shielded (part (b) of FIG. 2). As a result, a detected state in which the paper surface sensor 32 outputs to the state determining portion 81 of the control portion 80 is changed from a light transmitting state to a light shielding state.

When the state determining portion 81 detects a change in the detected state in which the paper surface sensor 32 outputs, that is, a state change of the detecting flag 24, the state determining portion 81 notifies a change in the state of detecting flag 24 of the control portion 80. The control portion 80 determines that the sheet S which is stacked on the stacking plate 52 of the sheet accommodating unit 50 is set in a position in which the pickup roller 21 is possible to feed the sheet S, based on the notification of the state change in the detecting flag 24 from the state determining portion 81. And the control portion 80 instructs the drive control portion 82 to stop driving the lift-up drive unit 70, and the drive control portion 82 stops driving the lift-up drive unit 70. By performing the operation which is described above, a preparation, in which the uppermost sheet S which is stacked on the stacking plate 52 is fed to the image forming portion 100A of the printer 100, is completed. After that, the control portion 80 instructs the drive control portion 82 to drive the feeding drive unit 60, the drive control portion 82 starts driving of the feeding drive unit 60, and the sheet S which is stacked on the stacking plate 52 is conveyed to the image forming portion 100A.

And when the sheet S is fed to the image forming portion 100A by the pickup roller 21, since the pickup roller 21 is pressed by the pick spring 31 via the roller holder 23, the pickup roller 21 descends in a downward direction in FIG. 2 by the number of sheets S which are fed. As a result, since the detecting flag 24 descends in a downward direction in FIG. 2 as well, the paper surface sensor 32 detects a state change from a light shielding state to a light transmitting state. When the state determining portion 81 detects that the detected state which is output from the paper surface sensor 32 is changed from a light shielding state to a light transmitting state, the state determining portion 81 notifies the control portion 80 of the state change of the detecting flag 24. The control portion 80 instructs the drive control portion 82 to drive the lift-up drive unit 70, and the drive control portion 82 drives the lift-up drive unit 70. And when the detected state which is output from the paper surface sensor 32 changes from a light transmitting state to a light shielding state, the control portion 80 stops the lift-up drive unit 70. By the sheet feeding control which is described above, the uppermost sheet S which is stacked on the stacking plate 52 is abutted with the pickup roller 21 at an appropriate position, and is fed to the image forming portion 100A.

[Configuration of Feeding Roller Unit]

Figure 4:
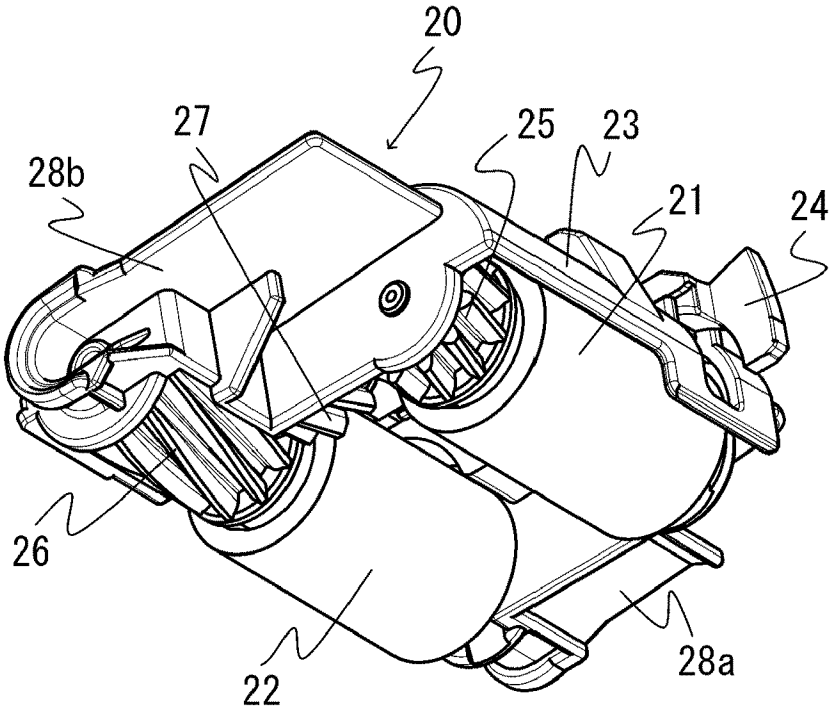
FIG. 4, part (a) and part (b), is a schematic perspective view showing a configuration of a feeding roller holding unit and a feeding roller unit according to the first embodiment.
Figure 4:
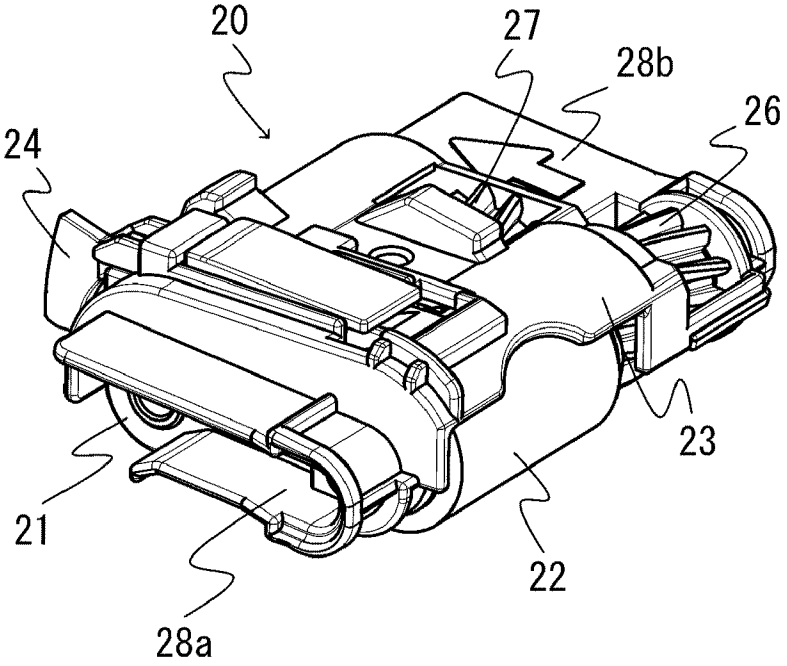

Next, a detailed configuration of the feeding roller unit 20 will be described. Part (a) and part (b) of FIG. 4 are views illustrating the configuration of the feeding roller unit 20. Part (a) of FIG. 4 is a schematic perspective view of the feeding roller unit 20 when it is viewed from an upper right direction in FIG. 2, part (b) of FIG. 4 is a schematic perspective view of the feeding roller unit 20 when it is viewed from a lower left in FIG. 2.

As shown in part (a) and part (b) of FIG. 4, the pickup roller 21 and the feeding roller 22 are rotatably supported by the roller holder 23. On one end portion of the pickup roller 21, a pickup roller gear 25 is integrally mounted, and the other end portion is rotatably supported by the roller holder 23. Further, on one end portion of the feeding roller 22 which is on a same side as one end portion of the pickup roller 21, a feeding roller gear 26 is integrally mounted, and the other end portion is rotatably supported by the roller holder 23. And the idler gear 27 for transmitting a drive of the feeding roller gear 26 to the pickup roller gear 25 is rotatably supported by the roller holder 23 between the pickup roller gear 25 and the feeding roller gear 26. Further, guide portions 28*a* and 28*b* are provided with the roller holder 23 as guidance guides for preventing incorrect mounting by regulating a direction of mounting and dismounting of the feeding roller unit 20 when a user or a service person performs mounting and dismounting of the feeding roller unit 20. Incidentally, the guide portion 28*a* is also referred to as a guide portion F and the guide portion 28*b* is also referred as a guide portion R. In the embodiment, to prevent incorrect mounting of the feeding roller unit 20, an arrow (a guide direction) which indicates an insertion direction of the feeding roller unit 20 is formed on a surface of the guide portion 28*b* which is shown in part (a) of FIG. 4.

The control, in which the sheet S which is stacked on the stacking plate 52 of the sheet accommodating unit 50 is set at a position in which the pickup roller 21 is possible to feed the sheet S by the control portion 80, is as described above. Next, a control until the sheet S is fed by the feeding roller unit 20 will be described. In order to feed the sheet S which is stacked on the stacking plate 52, the control portion 80 instructs drive of the feeding drive unit 60 to the drive control portion 82. When the drive of the feeding drive unit 60 is started by the control of the drive control portion 82, the drive of the feeding drive unit 60 is transmitted to the feeding roller gear 26 via a gear train (not shown) which is provided with the feeding roller holding unit 30. When the feeding roller gear 26 is driven, the feeding roller 22 is rotationally driven and the idler gear 27 is driven. And when the idler gear 27 is driven, the pickup roller gear 25 is driven, and when the pickup roller gear 25 rotationally drives the pickup roller 21, a feeding operation of the sheet S is started.

[Control of Detecting Flag]

Figure 5:
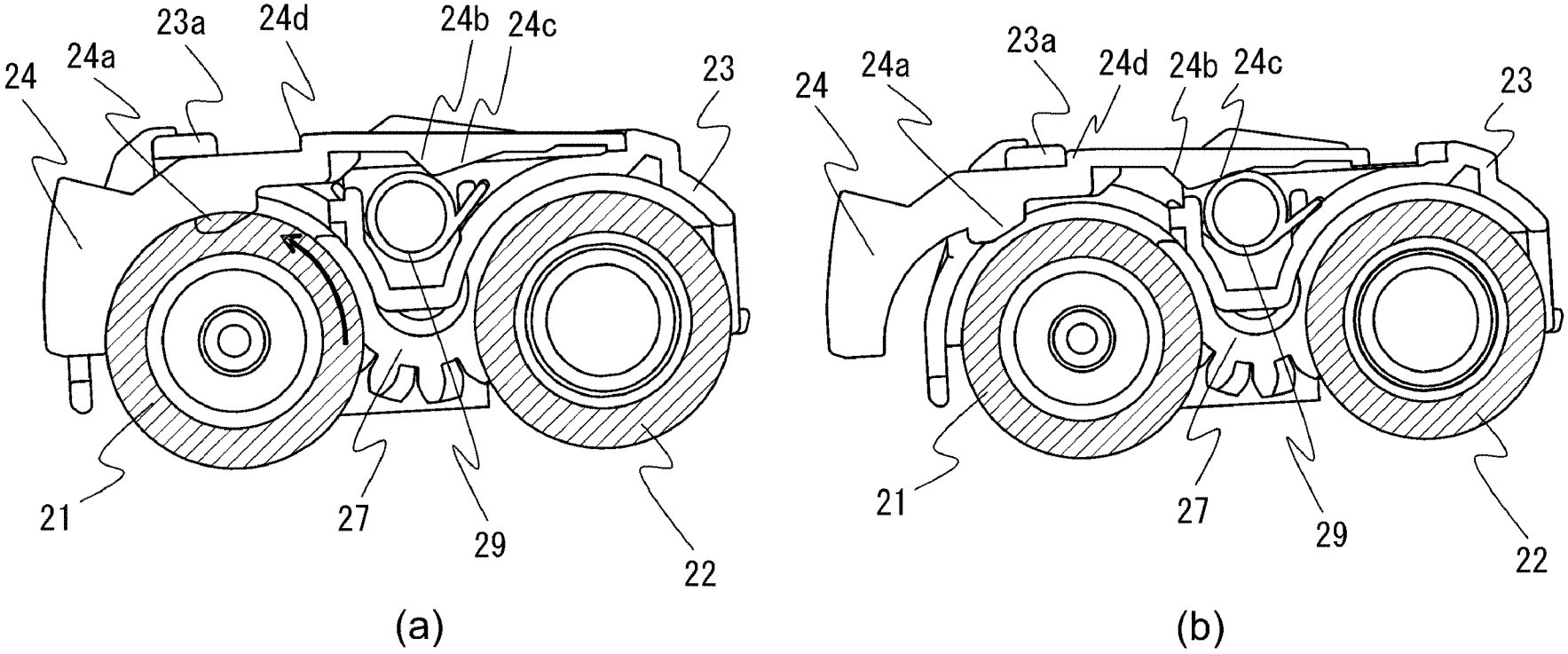
FIG. 5, part (a) and part (b), is a sectional view showing ae state of a detecting flag of the feeding roller unit according to the first embodiment.

Part (a) and part (b) of FIG. 5 are sectional views illustrating a state of the detecting flag 24 of the feeding roller unit 20, part (a) of FIG. 5 shows a state of the detecting flag 24 in a case that the detecting flag 24 is positioned at a retracted position, and part (b) of FIG. 5 shows a state of the detecting flag 24 in a case that the detecting flag 24 is positioned at a projected position. As described above, when the detecting flag 24 transmits or shields the light from the light emitting portion of the paper surface sensor 32, the paper surface sensor 32 detects a state of the detecting flag 24. Based on a state of the detecting flag 24 which is detected by the paper surface sensor 32, the control portion 80 controls height at which the stacking plate 52 of the sheet accommodating unit 50 is lifted up.

The feeding roller unit 20 includes a configuration in which the detecting flag 24 is possible to move from the retracted position which is shown in part (a) of FIG. 5 to the projected position which is shown in part (b) of FIG. 5. Next, a method of maintaining the retracted position and the projected position of the detecting flag 24 of the feeding roller unit 20, and a method of moving the detecting flag 24 from the retracted position to the projected position, which are characteristic configurations of the present invention, will be described by using part (a) and part (b) of FIG. 5.

In the detecting flag 24 which is shown in part (a) of FIG. 5, a convex portion 24*a* is a convex portion which protrudes in a direction of the pickup roller 21, and when the detecting flag 24 is in the retracted position, the convex portion 24*a* is held in a state that rubber material of the pickup roller 21 is concaved. Further, as shown in part (a) of FIG. 5, an abutting portion 24*b* is an inclined surface which is abutted with a state holding spring 29 when the detecting flag 24 is in the retracted position (a first position). The state holding spring 29 (a pressing portion) is provided to hold a state of the detecting flag 24 and a torsion coil spring is used for the state holding spring 29. On the other hand, as shown in part (b) of FIG. 5, an abutting portion 24*c* is an inclined surface which is abutted with the state holding spring 29 when the detecting flag 24 is in the projecting position (a second position). Further, an abutting portion 24*d* is an abutting portion which is provided on a side of the detecting flag 24, and an abutting portion 23*a* is an abutting portion which is provided on a side of the roller holder 23. As will be described below, when the detecting flag 24 moves to a left direction in the figure, the abutting portion 24*a* of the detecting flag 24 abuts against the abutting portion 23*a* of the roller holder 23, so the detecting flag 24 is prevented from moving further to the left direction in the figure.

As shown in part (a) and part (b) of FIG. 5, both arm portions of the state holding spring 29 is fixed to the roller holder 23. When the detecting flag 24 moves from a state in which the detecting flag 24 abuts against the abutting portion 24*b* which is shown in part (a) of FIG. 5 to a state in which the detecting flag 24 abuts against the abutting portion 24*c* which is shown in part (b) of FIG. 5, a coil portion of the state holding spring 29 moves in an up and down direction in the figure along a shape of the detecting flag 24 which abuts against. Incidentally, the detecting flag 24 is possible to move in a right and left direction in FIG. 5, however, the detecting flag 24 is restricted from moving in the up and down direction and a depth direction in FIG. 5 by the roller holder 23.

First, in a case that the detecting flag 24 is positioned at the retracted position which is shown in part (a) of FIG. 5, a configuration in which the detecting flag 24 holds a state of the retracted position will be described. As described above, in a case that the detecting flag 24 is positioned at the retracted position, the coil portion of the state holding spring 29 abuts against the abutting portion 24*b* of the detecting flag 24. As shown in part (a) of FIG. 5, the coil portion of the state holding spring 29 presses the abutting portion 24*b* in an upward direction in the figure. However, since the abutting portion 24*b* is the inclined surface, the state of the retracted position of the detecting flag 24 is held by converting a direction of pressing force which is applied from the coil portion of the state holding spring 29 to a direction along the inclined surface (a retracted direction).

Next, an operation, when the detecting flag 24 moves from the retracted position to the projected position, will be described. When the detecting flag 24 is positioned in the retracted position in which the coil portion of the state holding spring 29 abuts against the abutting portion 24*b*, the convex portion 24*a* of the detecting flag 24 is held in a state that the rubber material of the pickup roller 21 is concaved. By the control of the control portion 80, the drive of the feeding drive unit 60 is transmitted to the pickup roller 21 via the feeding roller gear 26, the idler gear 27 and the pickup roller gear 25, and the pickup roller 21 starts rotating in an arrow direction (a counterclockwise direction) in part (a) of FIG. 5. Then, the convex portion 24*a* of the detecting flag 24 is pushed out in a rotational direction of the pickup roller 21 (in a projecting direction) against a holding force of the state holding spring 29 (a pressing force against the detecting flag 24). As a result, an abutting part of the detecting flag 24 against the coil portion of the state holding spring 29 moves from the abutting portion 24*b* to the abutting portion 24*c*. Even in a neutral point in which a direction of the pressing force of the state holding spring 29 against the detecting flag 24 switches, that is, a peak portion of the inclined surface between the abutting portion 24*b* and the abutting portion 24*c* of the detecting flag 24, the convex portion 24*a* maintains a state that the rubber of the pickup roller 21 is concaved. Therefore, the coil portion of the state holding spring 29, which abuts against the detecting flag 24, moves beyond the neutral point to a side of the inclined surface of the abutting portion 24*c*, and the detecting flag 24 is securely pushed toward the projected position (to a side of a left direction in part (b) of FIG. 5).

Further, since the abutting portion 24*c* of the detecting flag 24 is an inclined surface, by converting a direction of pressing force which is applied from the coil portion of the state holding spring 29 to a direction along the inclined surface (a projected direction), the detecting flag 24 is moved in a direction toward the projected position. And when the detecting flag 24 moves in a projecting direction (in a left direction in the figure), by abutting the abutting portion 24*d* of the detecting flag 24 and the abutting portion 23*a* of the roller holder 23, the movement of the detecting flag 24 is completed. Incidentally, in the projected position in which the abutting portion 24*d* of the detecting flag 24 and the abutting portion 23*a* of the roller holder 23 abut, the coil portion of the state holding spring 29 and the abutting portion 24*c* of the detecting flag 24 continue to abut. Thus, since the detecting flag 24 is pressed in the direction toward the projected position by the coil portion of the state holding spring 29, the detecting flag 24 is held in a state that the detecting flag 24 is positioned in the projected position. Incidentally, in a case of a state of the projected position in which the coil portion of the state holding spring 29 abuts against the abutting portion 24*c* of the detecting flag 24, the convex portion 24*a* of the detecting flag 24 is spaced away from the rubber material of the pickup roller 21 and does not interfere with the pickup roller 21. Therefore, the detecting flag 24 is configured that once the detecting flag 24 is shifted to the state of the projected position, the detecting flag 24 will not return to a state of the retracted position in which the coil portion of the state holding spring 29 abuts against the abutting portion 24*b* of the detecting flag 24.

As described above, by being configured that the detecting flag 24 is movable, it is possible to move the detecting flag 24 from the retracted position to the projected position. Further, by interfering the detecting flag with the rubber material of the pickup roller 21 and providing the state holding spring 29, it is possible to securely move from the retracted position to the projected position by using a small space.

[New Product Detection of Feeding Roller Unit 20]

Figure 6:
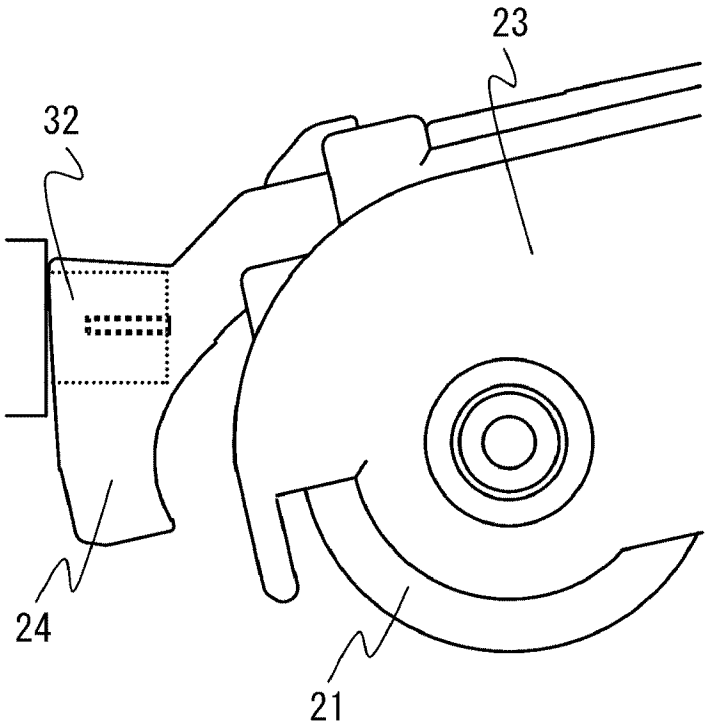
FIG. 6, part (a) and part (b), is a view illustrating a positional relationship between the detecting flag of the feeding roller unit and a paper surface sensor according to the first embodiment.
Figure 6:
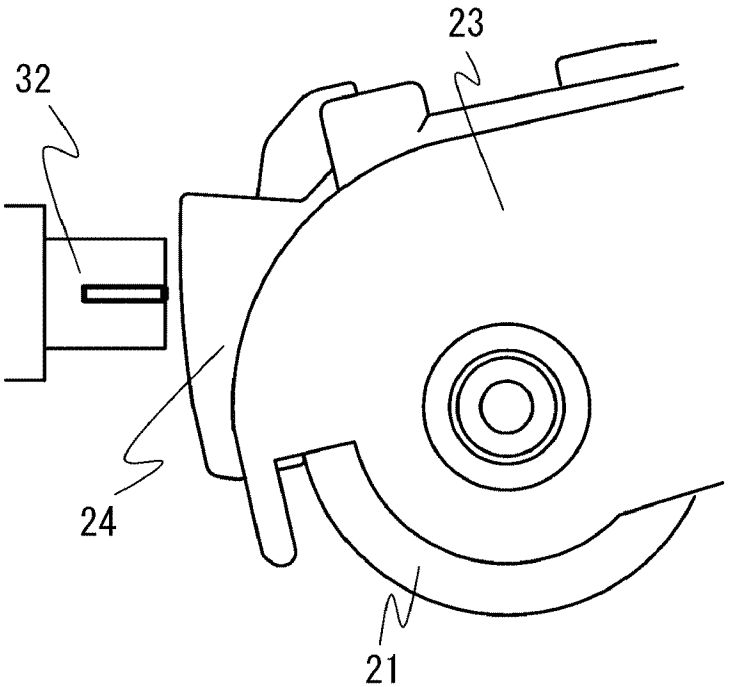

Next, a new product detection of the feeding roller unit 20 will be described. Part (a) of FIG. 6 shows a following state. That is, part (a) of FIG. 6 is a view showing a state that the feeding roller unit 20 in which the detecting flag 24 is held in the state of the retracted position, is inserted into (mounted on) the feeding roller holding unit 30, and is in a position that the pickup roller 21 is possible to feed the sheet S by the lift-up drive unit 70. At this time, since the detecting flag 24 is positioned in a position away from the paper surface sensor 32, the paper surface sensor 32 is in the light transmitting state and does not detect the detecting flag 24. On the other hand, part (b) of FIG. 6 show a following state. That is, part (b) of FIG. 6 is a view showing a state that the feeding roller unit 20 in which the detecting flag 24 is held in the state of the projected position, is inserted into (mounted on) the feeding roller holding unit 30, and is in a position that the pickup roller 21 is possible to feed the sheet S by the lift-up drive unit 70. At this time, since the detecting flag 24 is in a state which shields the light which is emitted from the paper surface sensor 32, the paper sensor 32 detect the detecting flag 24.

First, a positional relationship of the detecting flag 24 when the feeding roller unit 20 is replaced will be described. As described above, a new product of the feeding roller unit 20 is in a state that the detecting flag 24 is positioned in the retracted position. When the feeding roller unit 20 is replaced with a new product, a user or a service person opens the right door 115 and dismounts the separating roller unit 40 and the feeding roller unit 20 which are used. And the user or the service person mounts the new product of the feeding roller unit 20 and the separating roller unit 40, and closes the right door 115. A state of the detecting flag 24 at this time is a state which is shown in part (a) of FIG. 2. And the lift-up drive unit 70 is driven and the stacking plate 52 of the sheet accommodating unit 50 is lifted up, and the sheet S which is stacked on the stacking plate 52 is raised in a direction of the pickup roller 21 and the pickup roller 21 and the uppermost sheet S are contacted. By driving the lift-up drive unit 70 for a predetermined period of time, the feeding roller unit 20 is set to be a state which is shown as part (a) of FIG. 6, in which the sheet S which is stacked on the stacking plate 52 of the sheet accommodating unit 50 is possible to be fed by the pickup roller 21. After that, when the feeding roller unit 20 is driven, as described above, the detecting flag 24 moves from the retracted position to the projected position, and as shown in part (b) of FIG. 6, the paper surface sensor 32 is set to the light shielded state. Incidentally, in the feeding roller unit 20 in which the detecting flag 24 is moved to the projected position, the detecting flag 24 is configured that a state of the projected position is continued to be held.

[Control Sequence for Replacing Feeding Roller Unit]

Figure 7:
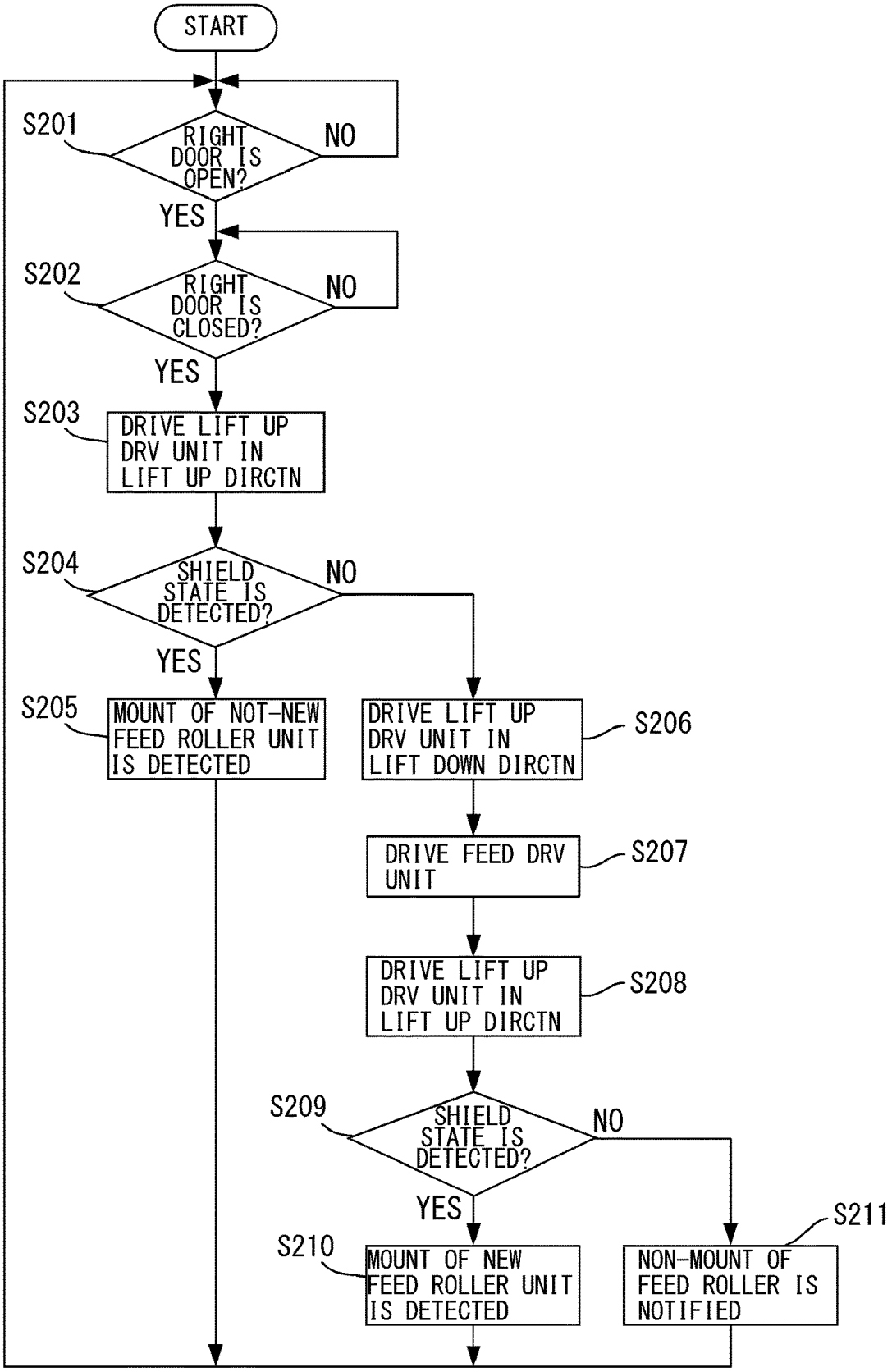
FIG. 7 is a flowchart showing a new product detecting process of the feeding roller unit according to the first embodiment.

Next, a control sequence which performs a detection of a replacing operation of the feeding roller unit 20 and a detection of a new product of the feeding roller unit 20 will be described. FIG. 7 is a flowchart showing the control sequence for replacing the feeding roller unit 20. A process which is shown in FIG. 7 is performed by the control portion 80 when a power source of the printer 100 is turned on and the control portion 80 is started. Incidentally, in a case that an opening and closing operation of the right door 115 is performed, the stacking plate 52 is set in a state that the stacking plate 52 is positioned at a bottom of the accommodating cassette 51 which is shown in part (a) of FIG. 2.

In Step (hereinafter referred to as "S") 201, the control portion 80 instructs the state determination portion 81 to monitor an opening state of the right door 115 and determines whether the state determining portion 81 detects the opening state of the right door 115 or not based on the detected result of the right door sensor 116. In a case that the state determining portion 81 determines that the opening state of the right door 115 is detected, the control portion 80 proceeds a process to S202, and in a case that the state determining portion 81 determines that the opening state of the right door 115 is not detected, the control portion 80 returns the process to S201.

In S202, the control portion 80 instructs the state determination portion 81 to monitor a closed state (an obstructed state) of the right door 115 and determines whether the state determining portion 81 detects the closed state (the obstructed state) of the right door 115 or not based on the detected result of the right door sensor 116. In a case that the state determining portion 81 determines that the closed state of the right door 115 is detected, the control portion 80 determines that the opening and closing operation of the right door 115 has been performed and the replacing process of the feeding roller unit 20 has been completed, and proceeds a process to S203. On the hand, in a case that the state determining portion 81 determines that the closed state of the right door 115 is not detected, the control portion 80 determines that the right door 115 is in the opening state and the replacing process of the feeding roller unit 20 has not been completed, and returns the process to S202.

In S203, in order to determine whether the feeding roller unit 20 is mounted or not, the control portion 80 instructs the drive control portion 82 to drive the lift-up drive unit 70 and the drive control unit 82 drives the lift-up drive unit 70 in a lift-up direction for a predetermined time. Incidentally, the predetermined time refers to a time which requires to drive the lift-up drive unit 70 in the lift-up direction and move the feeding roller unit 20 to a state which is shown in part (a) of FIG. 6, in which the pickup roller 21 is possible to feed the sheet S which is stacked on the stacking plate 52 in an initial state.

In S204, the control portion 80 obtains a detecting state of the detecting flag 24 of the paper surface sensor 32 from the state determining portion 81. And the control portion 80 determines whether the paper surface sensor 32 detects the detecting flag 24 or not (the light shielding state), based on the detected result of the paper surface sensor 32 which is obtained from the state determining portion 81. Incidentally, as described above, in a case of the light transmitting state in which the paper surface sensor 32 detects the light from the light emitting portion, the paper sensor 32 does not detect the detecting flag 24, and in a case of the light shielding state in which the paper surface sensor 32 does not detect the light from the light emitting portion, the paper sensor 32 detects the detecting flag 24. In a case that the control portion 80 determines that the paper surface sensor 32 detects the detecting flag 24 (the light shielding state), the control portion 80 proceeds a process to S205, and in a case that the control portion 80 determines that the paper surface sensor 32 does not detect the detecting flag 24 (the light transmitting state), the control portion 80 proceeds the process to S206. In S205, the control portion 80 determines that the feeding roller unit 20 is mounted, however, it is not replaced with a new product of the feeding roller unit 20, and returns a process to S201. As a specific example of proceeding to the process of S205, for example, there is a case that the feeding roller unit 20 is not replaced even though the opening and closing operation of the right door is performed after performing a jam process operation when the sheet S is retained on the conveying passage, etc.

In S206, the control portion 80 instructs the drive control portion 82 to drive the lift-up drive unit 70 in order to return the stacking plate 52 to the initial state, and the drive control portion 82 drives the lift-up drive unit 70 in a lift-down direction for a predetermined time.

In S207, since the paper surface sensor 32 does not detect the detecting flag 24, the control 80 determines that either the feeding roller unit 20 is not mounted or a new product of the feeding roller unit 20 is mounted. Therefore, the control portion 80 instructs the drive control portion 82 to drive the feeding drive unit 60, and the drive control portion 82 drives the feeding drive unit 60 for a certain period of time. For example, in a case that a new product of the feeding roller unit 20 is mounted, when the feeding drive unit 60 is driven, the feeding roller gear 26 of the feeding roller unit 20 is driven. And the pickup roller gear 25 and the pickup roller 21 are driven via the feeding roller gear 26. Then, the detecting flag 24 moves from the state of the retracted position (part (a) of FIG. 5) to the state of the projected position (part (b) of FIG. 5).

In S208, the control portion 80 instructs the drive control portion 82 to drive the lift-up drive unit 70 in order to determine whether the feeding roller unit 20 is mounted, and the drive control portion 82 drives the lift-up drive unit 70 in the lift-up direction for a predetermined time.

In S209, the control portion 80 obtains a detecting state of the detecting flag 24 of the paper surface sensor 32 from the state determining portion 81, and determines whether the paper surface sensor 32 detects the detecting flag 24 or not (the light shielding state), based on the detected result of the paper surface sensor 32 which is obtained. In a case that the control portion 80 determines that the paper surface sensor 32 detects the detecting flag 24 (the light shielding state), the control portion 80 proceeds a process to S210, and in a case that the control portion 80 determines that the paper surface sensor 32 does not detect the detecting flag 24 (the light transmitting state), the control portion 80 proceeds the process to S211. In S210, the control portion 80 determines that the feeding roller unit 20 has been replaced with a new product and returns a process to S201.

In S211, the control portion 80 determines that the feeding roller unit 20 is not mounted, and notifies it by displaying an indication that the feeding roller unit 20 is not mounted on a display portion of the operation portion 114, and returns a process to S201. Incidentally, as an example of proceeding to S211, there is a case that the right door 115 is closed without remembering to mount the feeding roller unit 20 after removing the feeding roller unit 20 in order to replace the feeding roller unit 20.

As described above, in the embodiment, the paper surface sensor 32 detects the position of the pickup roller 21 and detects a new product of the feeding roller unit 20 when the opening and closing operation of the right door 115 is performed. By detecting a new product of the feeding roller unit 20, it is possible to automatically detect a replacement of a new product of the feeding roller unit 20 without increasing cost by using only one sensor. Further, a movement of the detecting flag 24 of the feeding roller unit 20 from the retracted position to the projected position is realized in a small space within the feeding roller unit 20 by using the convex portion 24*a* which interferes with the rubber material of the pickup roller 21 and the state holding spring 29.

As described above, according to the embodiment, it is possible to automatically detect that the feeding roller is replaced with a new product.

Second Embodiment

In the first embodiment, the control, in which the uppermost sheet S which is stacked on the stacking plate abuts against the pickup roller and is set at the position which is possible to be fed by lift-up controlling the stacking plate of the sheet accommodating unit, is described. In a second embodiment, a control, in which the uppermost sheet S abuts against the pickup roller and is set at the position which is possible to be fed in a different configuration from the first embodiment, will be described. Incidentally, the image forming apparatus in the embodiment is provided with a same configuration as the image forming apparatus in the first embodiment, and a same reference numeral as in the first embodiment is used for the same apparatus and the same members, thereby, descriptions will be omitted here.

[Configuration of Sheet Feeding Apparatus]

Figure 8:
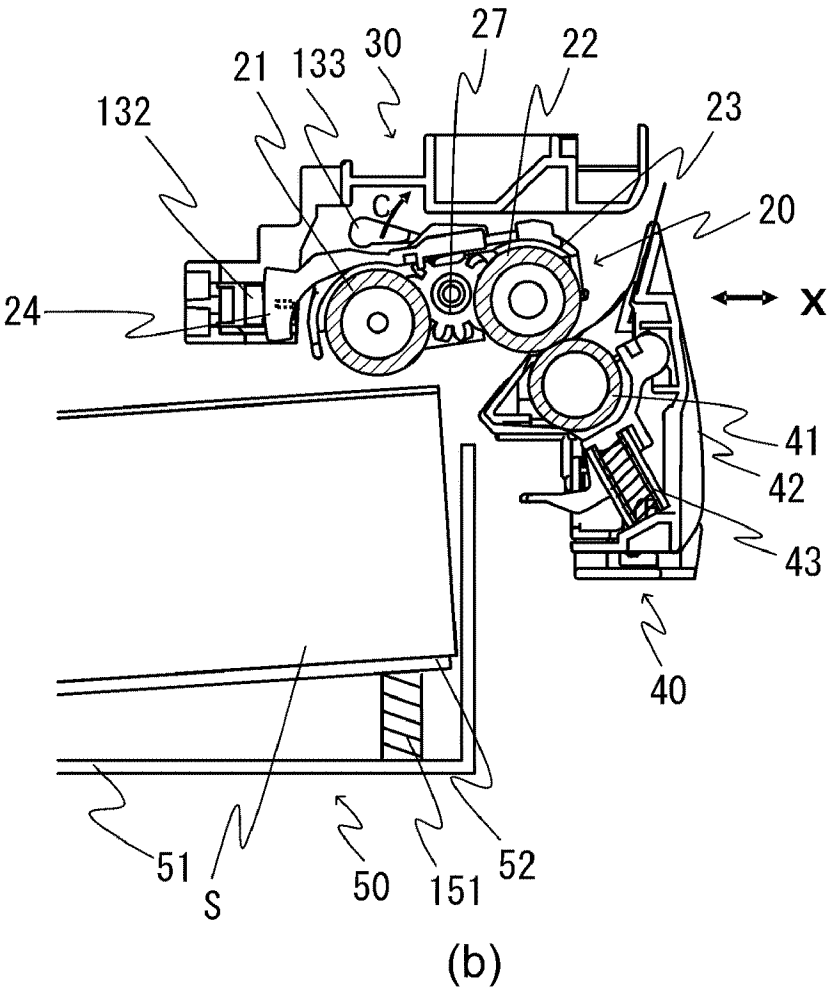
FIG. 8, part (a) and part (b), is a sectional view showing a configuration of the sheet feeding apparatus according to the second embodiment.
Figure 8:
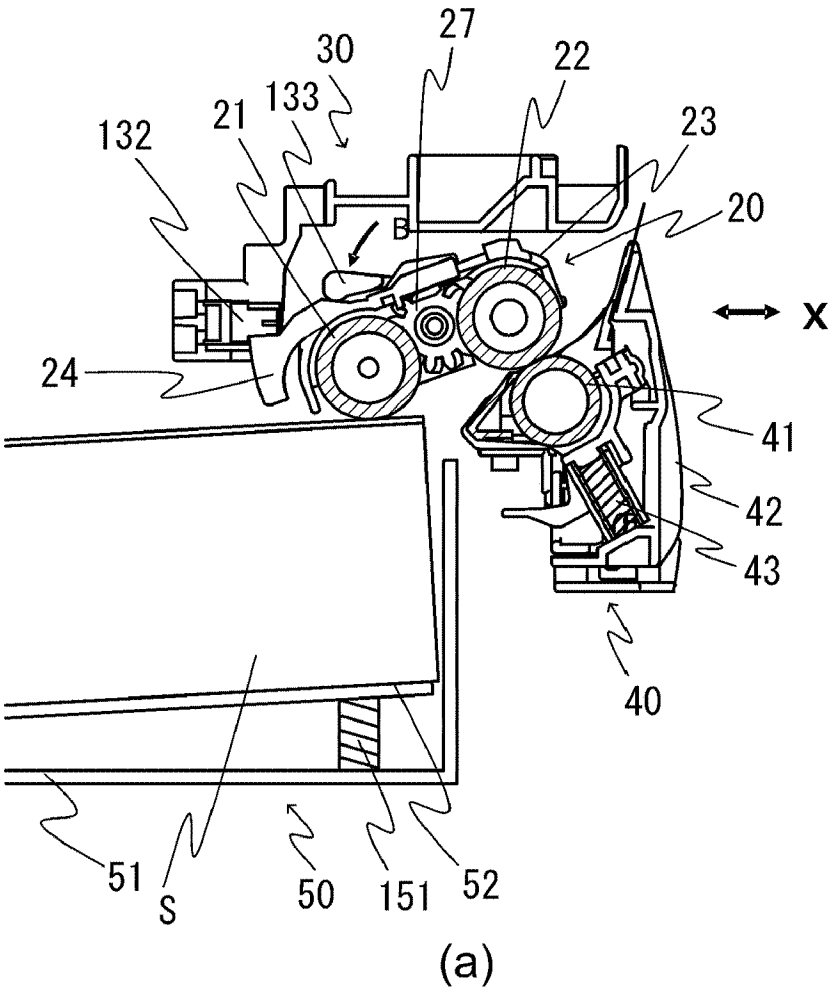

Part (a) and part (b) of FIG. 8 are sectional views showing a configuration of the sheet feeding apparatus 10 in the embodiment. Part (a) of FIG. 8 shows a state in which the uppermost sheet S which is stacked on the stacking plate 52 of the sheet accommodating unit 50 is positioned at a feeding start position in which the uppermost sheet S abuts against the pickup roller 21. On the other hand, part (b) of FIG. 8 shows a state that the uppermost sheet S which is stacked on the stacking plate 52 of the sheet accommodating unit 50 is spaced away from the pickup roller 21. Configurations of the feeding roller unit 20 and the separating roller unit 40 which are shown in part (a) and part (b) of FIG. 8 is same as in the first embodiment. On the other hand, a feeding roller holding unit 30 in the embodiment is different from the feeding roller holding unit 30 in the first embodiment, in that the paper surface sensor 32 and the pick spring 31 are deleted and an abutting/spacing (contacting/separating) sensor 132 and a pickup roller abutting/spacing (contacting/separating) arm 133 are provided. Further, a sheet accommodating unit 50 in the embodiment is different from the sheet accommodating unit 50 in the first embodiment, in that it includes a sheet pressing spring 151 which presses the stacking plate 52 which stacks the sheet S in a direction of the pickup roller 21.

The abutting/spacing sensor 132 is a photo interrupter which includes a light emitting portion which emits light and a light receiving portion which receives light which is emitted from the light emitting portion, similar to the paper surface sensor 32 in the first embodiment. The abutting/spacing sensor 132 detects a light shielding state in which the detecting flag 24 of the feeding roller unit 20 shields light from the light emitting portion or a light transmitting state in which the detecting flag 24 of the feeding roller unit 20 does not shield light from the light emitting portion and outputs the detected result of the control portion 80 to the state determining portion 81. Further, the pickup roller abutting/spacing arm 133 (hereinafter referred to as an abutting/spacing arm 133) switches the pickup roller 21 to a position of abutting (contacting) state in which the uppermost sheet S which is stacked on the stacking plate 52 of the sheet accommodating unit 50 abuts against the pickup roller 21 or to a position of spacing (separating) state. The abutting/spacing arm 133 includes a rotational center coaxially with a feeding roller support member (not shown) which supports the feeding roller unit 20 and is rotatable. The feeding roller unit 20 also includes a rotational center coaxially with the feeding roller support member (not shown). That is, the feeding roller unit 20 and the abutting/spacing arm 133 includes a rotational center coaxially and are rotatable.

[Control Portion of Sheet feeding Apparatus]

Figure 9:
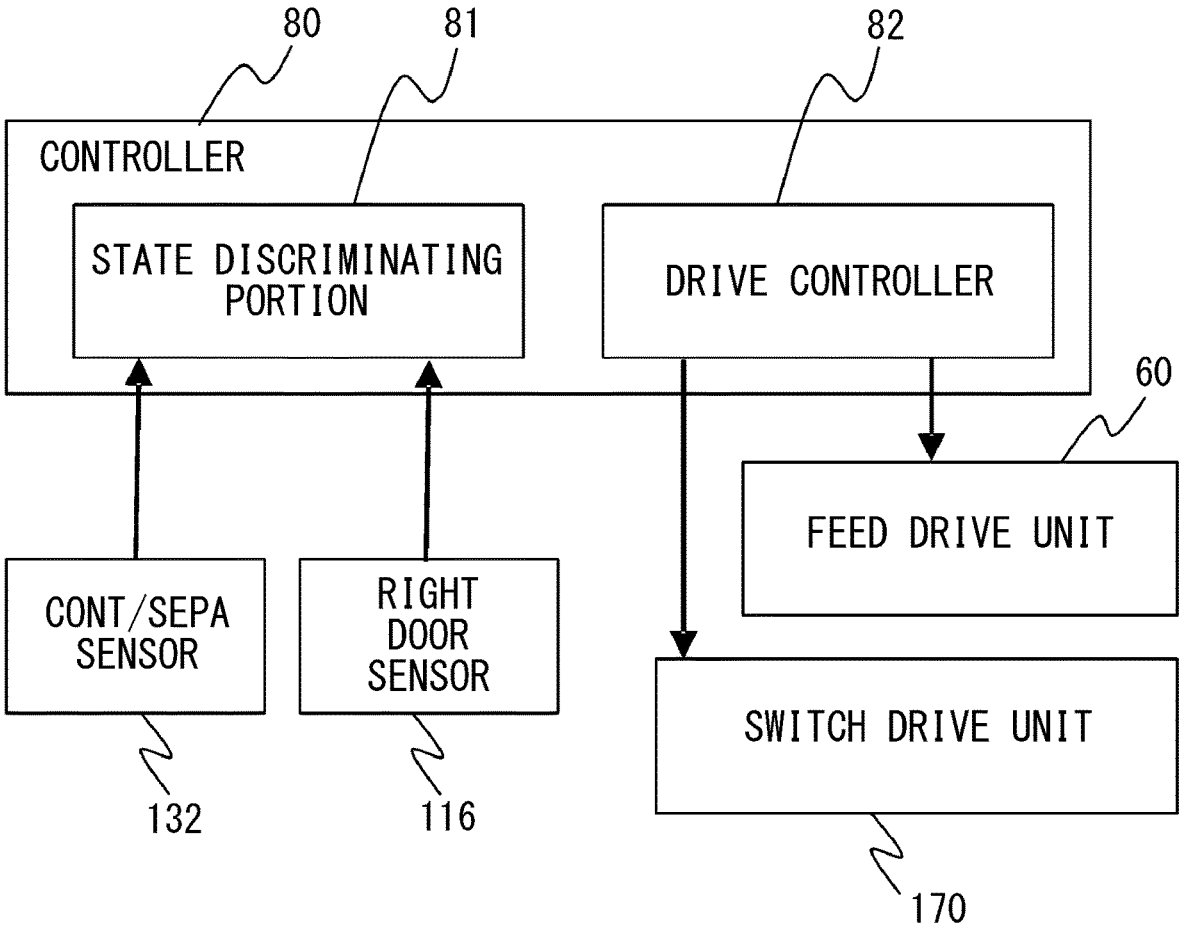
FIG. 9 is a control block diagram of the sheet feeding apparatus according to the second embodiment.

FIG. 9 is a control block diagram showing a configuration of the control portion of the sheet feeding apparatus 10 in the embodiment. The control portion 80 which controls the sheet feeding apparatus 10 includes the state determining portion 81 which determines a state based on a signal which is output from each sensor, and the drive control portion 82 which controls each drive unit. The state determining portion 81 determines an abutting state or a spacing state of the pickup roller 21 according to the signal that the abutting/spacing sensor 132 outputs based on the light transmitting state or the light shielding state of the detecting flag 24 of the feeding roller unit 20. Further, the state determining portion 81 determines an opened state or a closed state of the right door 115 based on the detected result of the right door sensor 116. The drive control portion 82 controls a switching drive unit 170 which switches the abutting state or the spacing state between the pickup roller 21 and the sheet S by rotationally moving the feeding drive unit 60 which drives the feeding roller unit 20 which feeds the sheet S and the abutting/spacing arm 133. The switching drive unit 170 is configured to branch the feeding drive unit 60 and to operate only when the feeding drive unit 60 is rotated in a reverse direction. The switching drive unit 170 switches a state of the abutting/spacing arm 133 to the abutting state in which the sheet S abuts against the pickup roller 21 or the spacing state by rotating a cam (not shown) which is connected to the abutting/spacing arm 133.

[State Control of Pickup Roller]

Next, a positional control of the pickup roller 21 by switching the state of the abutting/spacing arm 133 and an abutting and spacing relationship with the uppermost sheet S which is stacked on the stacking plate 52 of the pickup roller 21 will be described.

First, a relationship of the light shielding state and the light transmitting state of the abutting/spacing sensor 132 by the detecting flag 24 and the abutting state and the spacing state between the uppermost sheet S and the pickup roller 21 will be described. Part (a) of FIG. 8 shows a state in which the uppermost sheet S which is stacked on the stacking plate 52 abuts against the pickup roller 21. At this time, the detecting flag 24 is positioned at a lower side of the abutting/spacing sensor 132 in the figure, and the abutting/spacing sensor 132 becomes the light transmitting state in which the light receiving portion receives light which is emitted from the light emitting portion. Therefore, based on the detected result of the detecting flag 24 from the abutting/spacing sensor 132, the state determining portion 81 determines that the pickup roller 21 abuts against the uppermost sheet S which is stacked on the stacking plate 52. On the other hand, part (b) of FIG. 8 shows a state that the uppermost sheet S which is stacked on the stacking plate 52 and the pickup roller 21 are spaced. At this time, the detecting flag 24 is positioned in a state to shield the light which is emitted from the light emitting portion of the abutting/spacing sensor 132. Therefore, based on the detected result of the detecting flag 24 from the abutting/spacing sensor 132, the state determining portion 81 determines that the pickup roller 21 spaces away from the uppermost sheet S which is stacked on the stacking plate 52. Incidentally, in a case that the feeding roller unit 20 is replaced and the feeding roller unit 20 is inserted into (mounted on) the feeding roller holding unit 30, the feeding roller unit 20 becomes in a state which is shown in part (b) of FIG. 8. Incidentally, in part (b) of FIG. 8, since the abutting/spacing sensor 132 is in a state that the light is shielded by the detecting flag 24, a state in a case that the feeding roller unit 20 which is not a new product is mounted is shown. In a case that a new product of the feeding roller unit 20 is mounted, since the detecting flag 24 is positioned in the retracted position, the abutting/spacing sensor 132 become the light transmitting state in which light is not shielded by the detecting flag 24.

First, a control of switching a state of the pickup roller 21 from a state of spacing away from the uppermost sheet S to a state of abutting will be described. The control portion 80 instructs the drive control portion 82 to switch a state of the pickup roller 21 from a state of spacing away from the uppermost sheet S to a state of abutting. In order to shift the pickup roller 21 to the state of abutting against the uppermost sheet S, the drive control portion 82 drives the switching drive unit 170 by rotating the feeding drive unit 60 in a reverse direction and rotates the abutting/spacing arm 133 in a direction B (a counterclockwise direction) in part (a) of FIG. 8. The abutting/spacing arm 133 and the roller holder 23 are connected with a certain amount of rattle, and when the abutting/spacing arm 133 abuts against the roller holder 23, the roller holder 23 rotates in a direction B. On the other hand, the sheet S which is stacked on the stacking plate 52 is in a state of being lifted up in a direction toward the pickup roller 21 by the sheet pressing spring 151. As the roller holder 23 rotates in the direction B, the pickup roller 21 also rotates in the direction B and abuts against the uppermost sheet S which is stacked on the stacking plate 52. Thus, since a position of the detecting flag 24 is lowered in a direction toward the stacking plate 52, a state of the abutting/spacing sensor 132 changes from the light shielding state, in which light is shielded by the detecting flag 24, to the light transmitting state. And when the drive control portion 82 detects a change in the state of the abutting/spacing sensor 132 from the light shielding state to the light transmitting state, after the switching drive unit 170 is driven for a certain amount, the reverse rotation of the feeding drive unit 60 is stopped and a drive of the switching drive unit 170 is stopped. In this way, the control portion 80 moves the pickup roller 21 to a position in which the pickup roller 21 abuts against the sheet S and also moves the pickup roller 21 so that a proper pressing force is applied from the sheet pressing spring 151.

Next, a control of switching a state of the pickup roller 21 from a state in which the pickup roller 21 abuts against the uppermost sheet S to a state in which the pickup roller 21 is spaced away from the uppermost sheet S will be described. The control portion 80 instructs the drive control portion 82 to switch the state of the pickup roller 21 from the state in which the pickup roller 21 abuts against the uppermost sheet S to the state in which the pickup roller 21 is spaced away from the uppermost sheet S. In order to shift the pickup roller 21 to the state of being spaced away from the uppermost sheet S, the drive control portion 82 drives the switching drive unit 170 by rotating the feeding drive unit 60 in the reverse direction and rotates the abutting/spacing arm 133 in a direction C (a clockwise direction) in part (a) of FIG. 8. When the rattle between the abutting/spacing arm 133 and the roller holder 23 is eliminated and the abutting/spacing arm 133 abuts against the roller holder 23, the roller holder 23 rotates in the direction C. As the roller holder 23 rotates in the direction C, the pickup roller 21 also rotates in the direction C and is spaced away from the uppermost sheet S which is stacked on the stacking plate 52. Thus, since a position of the detecting flag 24 is lifted up in a direction toward the feeding roller holding unit 30, a state of the abutting/spacing sensor 132 changes from the light transmitting state, in which light is not shielded by the detecting flag 24, to the light transmitting state. And when the drive control portion 82 detects the change in the state of the abutting/spacing sensor 132 from the light transmitting state to the light shielding state, after the switching drive unit 170 is driven for a certain amount, the reverse rotation of the feeding drive unit 60 is stopped and the drive of the switching drive unit 170 is stopped. While the switching drive unit 170 is driven for a certain amount, the stacking plate 52 which is pressed by the sheet pressing spring 151 abuts against a stopper (not shown) which is provided in the sheet accommodating unit 50 and cannot be lifted up any further. In this way, the control portion 80 finishes a spacing operation of the pickup roller 21 at a position in which the switching drive unit 170 drives for a certain amount from a state that the pickup roller 21 is spaced away from the sheet S.

[Detecting New Product of the Feeding Roller Unit 20]

Next, a method of detecting a new products of the feeding roller unit 20 in the embodiment will be described. Here, part (b) of FIG. 8 is a view showing a state that the feeding roller unit 20 is replaced and the feeding roller unit 20 is inserted into (mounted on) the feeding roller holding unit 30. Then, in part (b) of FIG. 8, the detecting flag 24 is moved to a state that the detecting flag 24 is at the projected position (part (b) of FIG. 6), and since the abutting/spacing sensor 132 is set to the light shielding state, it is indicating a state that the feeding roller unit 20 which is not a new product has been mounted. On the other hand, in a case that the feeding roller unit 20 is a new product, since the detecting flag 24 is in a state of the retracted position (part (a) of FIG. 6), the abutting/spacing sensor 132 is set to the light transmitting state. When the control portion 80 instructs the drive control portion 82 to drive the feeding drive unit 60, and the drive control portion 82 drives the feeding drive unit 60 for a certain period of time, the detecting flag 24 shifts from a state of the retracted position (part (a) of FIG. 6) to a state of the projected position (part (b) of FIG. 6). As a result, the detecting flag 24 is set to a state which is shown in part (b) of FIG. 8, and the abutting/spacing sensor 132 is set to the light shielding state. In this way, the abutting/spacing sensor 132 in the embodiment and the paper surface sensor 32 in the first embodiment are same configurations with respect to the detecting flag 24, and it is possible to detect a new product of the feeding roller unit 20 based on a flowchart in FIG. 10 which will be described below.

[Control Sequence for Replacing Feeding Roller Unit]

Figure 10:
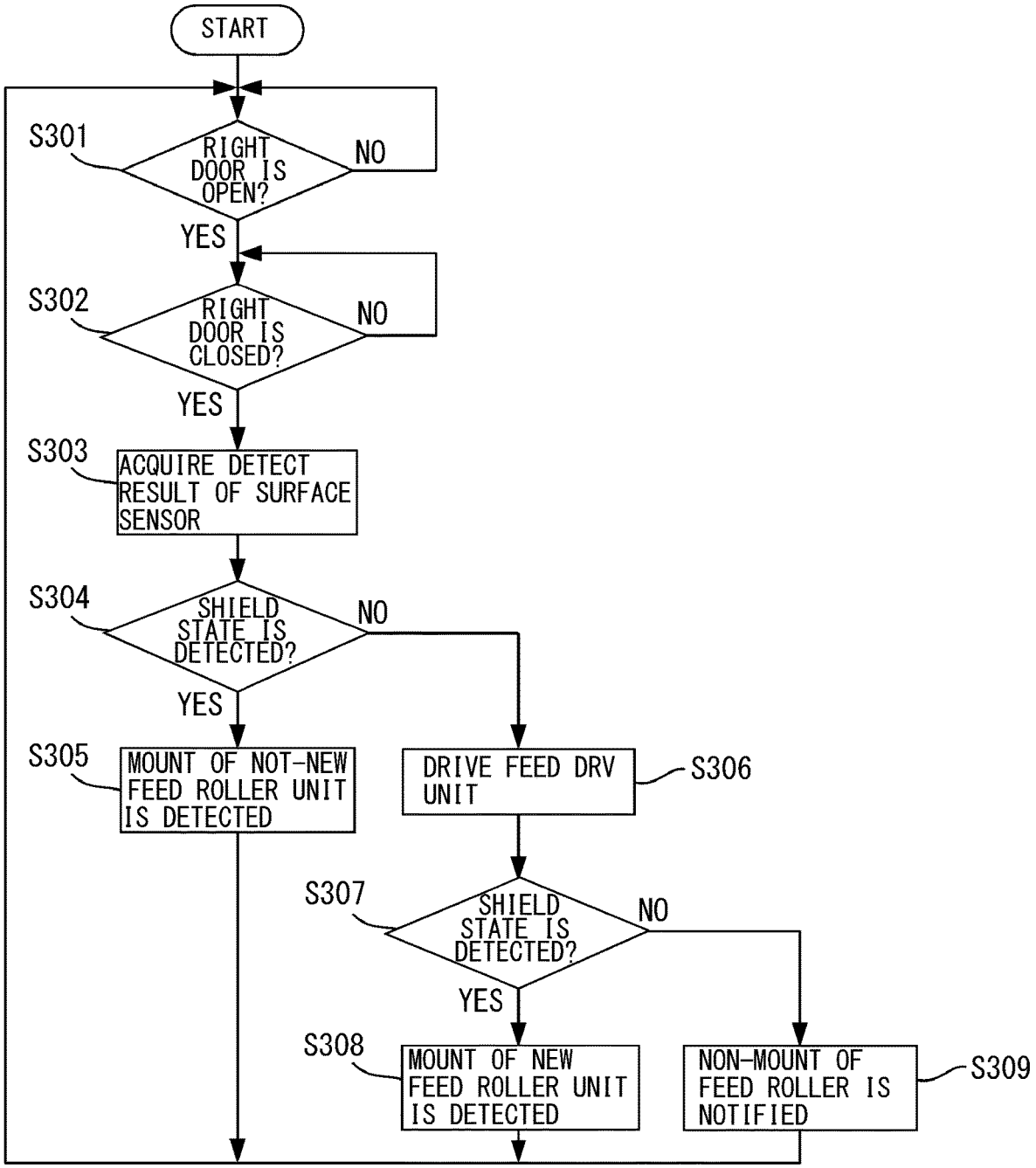
FIG. 10 is a flowchart showing the new product detecting process of the feeding roller unit according to the second embodiment.

Next, a control sequence which detects an operation of replacing the feeding roller unit 20 and detects a new product of the feeding roller unit 20 will be described. FIG. 10 is a flowchart showing the control sequence of replacing the feeding roller unit 20. A process which is shown in FIG. 10 is executed by the control portion 80 when the printer 100 is turned on and the control portion 80 is started.

In S301, the control portion 80 instructs the state determining portion 81 to monitor an opening state of the right door 115, and determines whether the state determining portion 81 detects the opening state of the right door 115 or not based on the detected result of the right door sensor 116. In a case that the control portion 80 determines that the state determining portion 81 detects the opening state of the right door 115, the control portion 80 proceeds a process to S302, and in a case that the control portion 80 determines that the state determining portion 81 does not detect the opening state of the right door 115, the control portion 80 returns the process to S301.

In S302, the control portion 80 instructs the state determining portion 81 to monitor a closed state (an obstructed state) of the right door 115, and determines whether the state determining portion 81 detects the closed state (the obstructed state) of the right door 115 or not based on the detected result of the right door sensor 116. In a case that the control portion 80 determines that the state determining portion 81 detects the closed state of the right door 115, the control portion 80 determines that the opening and closing operation of the right door 115 is preformed and the process of replacing the feeding roller unit 20 is finished and proceeds a process to S303. On the other hand, in a case that the control portion 80 determines that the state determining portion 81 does not detect the closed state of the right door 115, the control portion 80 determines that the right door 115 is in the opening state and the process of replacing the feeding roller unit 20 is not finished and returns the process to S302.

In S303, the control portion 80 obtains a detecting state of the detecting flag 24 of the abutting/spacing sensor 132 from the state determining portion 81. Incidentally, as described above, in a case of the light transmitting state in which the abutting/spacing sensor 132 detects the light from the light emitting portion, the abutting/spacing sensor 132 does not detect the detecting flag 24, and in a case of the light shielding state in which the abutting/spacing sensor 132 does not detect the light from the light emitting portion, the abutting/spacing sensor 132 detects the detecting flag 24.

In S304, the control portion 80 determines whether the abutting/spacing sensor 132 detects the detecting flag 24 or not (the light shielding state), based on the detected result of the abutting/spacing sensor 132 which is obtained from the state determining portion 81. In a case that the control portion 80 determines that the abutting/spacing sensor 132 detects the detecting flag 24 (the light shielding state), the control portion 80 proceeds a process to S305, and in a case that the control portion 80 determines that the abutting/spacing sensor 132 does not detect the detecting flag 24 (the light transmitting state), the control portion 80 proceeds the process to S306. In S305, the control portion 80 determines that the feeding roller unit 20 is mounted, however, it is not replaced with a new product of the feeding roller unit 20, and returns a process to S301.

In S306, since the abutting/spacing sensor 132 does not detect the detecting flag 24, the control 80 determines that either the feeding roller unit 20 is not mounted or a new product of the feeding roller unit 20 is mounted. Therefore, the control portion 80 instructs the drive control portion 82 to drive the feeding drive unit 60, and the drive control portion 82 drives the feeding drive unit 60 for a certain period of time. For example, in a case that a new product of the feeding roller unit 20 is mounted (part (a) of FIG. 6), when the feeding drive unit 60 is driven, the feeding roller gear 26 of the feeding roller unit 20 is driven. And the pickup roller gear 25 and the pickup roller 21 are driven via the feeding roller gear 26. Then, the detecting flag 24 moves from the state of the retracted position (part (a) of FIG. 6) to the state of the projected position (part (b) of FIG. 6) and shields light of the abutting/spacing sensor 132, and the abutting/spacing sensor 132 detects the detecting flag 24.

In S307, the control portion 80 obtains a detecting state of the detecting flag 24 of the abutting/spacing sensor 132 from the state determining portion 81, and determines whether the abutting/spacing sensor 132 detects the detecting flag 24 or not (the light shielding state), based on the detected result which is obtained. In a case that the control portion 80 determines that the abutting/spacing sensor 132 detects the detecting flag 24 (the light shielding state), the control portion 80 proceeds a process to S308, and in a case that the control portion 80 determines that the abutting/spacing sensor 132 does not detect the detecting flag 24 (the light transmitting state), the control portion 80 proceeds the process to S309. In S308, the control portion 80 determines that the feeding roller unit 20 has been replaced with a new product and returns a process to S301.

In S309, the control portion 80 determines that the feeding roller unit 20 is not mounted, and notifies it by displaying an indication that the feeding roller unit 20 is not mounted on a display portion of the operation portion 114, and returns a process to S301. Incidentally, as an example of proceeding to S309, there is a case that the right door 115 is closed without remembering to mount the feeding roller unit 20 after removing the feeding roller unit 20 in order to replace the feeding roller unit 20.

As described above, in the embodiment, by detecting the detecting flag 24 with the abutting/spacing sensor 132, the abutting/spacing sensor 132 detects the position of the pickup roller 21 and detects a new product of the feeding roller unit 20 when the opening and closing operation of the right door 115 is performed. By detecting a state of the detecting flag 24 while detecting a new product of the feeding roller unit 20, it is possible to automatically detect a replacement of a new product of the feeding roller unit 20 without increasing cost by using only one sensor. Further, a movement of the detecting flag 24 of the feeding roller unit 20 from the retracted position to the projected position is realized in a small space within the feeding roller unit 20 by using the convex portion 24*a* which interferes with the rubber material of the pickup roller 21 and the state holding spring 29.

Incidentally, in the embodiment, the switching drive unit 170 controls the abutting/spacing arm 133 by using a cam (not shown), however, for example, it is also possible to control a position by controlling a rack gear which is connected to the lift-up drive unit 70 in the first embodiment. Further, the sheet feeding apparatus 10 in the embodiment may also be provided with both of the lift-up drive unit 70 in the first embodiment and the switching drive unit 170 in the embodiment. Furthermore, the sheet feeding apparatus 10 which is provided with a laser beam printer is described as an example, however, an image forming apparatus to which the present invention is applied is not limited to this, and, for example, printers and copiers of other printing methods such as inkjet printers and copiers may also be applied As described above, according to the embodiment, it is possible to automatically detect that a feeding roller has been replaced with a new product.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-189171 filed on Nov. 22, 2021, which is hereby incorporated by reference herein in its entirety.

What is claimed is:

1. A sheet feeding apparatus comprising:

a stacking unit provided with a stacking plate on which a sheet is stacked and capable of performing up-and-down operation;

a feeding unit provided with a feed roller configured to feed the sheet, a rotatable supporting member configured to support the feed roller, and a detected member provided on the supporting member;

a holding unit provided with a detecting device configured to detect the detected member, provided above the stacking unit, and configured to dismountably hold the feeding unit;

a drive unit configured to cause the stacking plate to perform the up-and-down operation; and a control unit configured to control the drive unit, wherein the detected member is positioned in a first position where the detected member is not detected by the detecting device in a case that the feeding unit is new, and is moved from the first position to a second position where the detected member is projected so as to be detected by the detecting device when the new feeding unit is mounted on the holding unit and the feed roller is driven, wherein the control unit controls the drive unit to perform the up-and-down operation of the stacking plate so that the stacking plate is set to a feedable state of the sheet stacked on the stacking plate in a case that the feeding unit is mounted, and determines whether or not the feeding unit is new based on a detection result of the detecting device.

2. A sheet feeding apparatus according to claim 1, wherein the control unit determines that the feeding unit is not new in a case that the detecting device detects the detected member.

3. A sheet feeding apparatus according to claim 2, wherein the control unit, in a case that the detecting device does not detect the detected member and after driving the feed roller, determines that the feeding unit is new when the detecting device detects the detected member, and determines that the feeding unit is not mounted when the detecting device does not detect the detected member.

4. A sheet feeding apparatus according to claim 3, wherein the control unit controls the drive unit to lower the stacking plate from a feedable position of the sheet stacked on the stacking plate, and then to cause the feed roller to drive.

5. A sheet feeding apparatus comprising:

a stacking unit provided with a stacking plate on which a sheet is stacked;

a feeding unit provided with a feed roller configured to feed the sheet, a rotatable supporting member configured to support the feed roller, and a detected member provided on the supporting member;

a holding unit provided with a detecting device configured to detect a contacting state and a separating state between the sheet stacked on the stacking plate and the feed roller based on a detection result of the detected member and a switching member configured to switch a state of the feeding unit by lowering and raising the feeing unit so as to become the contacting state or the separating state where the sheet stacked on the stacking plate contacts or separates from the feed roller, provided above the stacking unit, and configured to dismountably hold the feeding unit; and a control unit configured to control the switching member to cause the feeding unit to lower, and set the sheet on the stacking plate to the feedable state base on a detection result of detecting device, wherein the detected member is positioned in a first position where the detected member is not detected by the detecting device in a case that the feeding unit is new, and is moved from the first position to a second position where the detected member is projected so as to be detected by the detecting device when the new feeding unit is mounted on the holding unit and the feed roller is drive, wherein in a case that the feeding unit is mounted, the control unit determines whether or not the feeding unit is new based on the detection result of the detecting device when the feeding unit is mounted.

6. A sheet feeding apparatus according to claim 5, wherein the control unit determines that the feeding unit is not new in a case that the detecting device detects the detected member.

7. A sheet feeding apparatus according to claim 6, wherein the control unit, in a case that the detecting device does not detect the detected member and after driving the feed roller, determines that the feeding unit is new when the detecting device detects the detected member, and determines that the feeding unit is not mounted when the detecting device does not detect the detected member.

8. A sheet feeding apparatus according to claim 7, wherein the feeding roller is the separating state where the feeding roller is separated from the sheet stacked on the stacking plate when the feeding unit is mounted on the holding unit.

9. A sheet feeding apparatus according to claim 1, wherein the detected member is provided with a projecting portion to interferes with the feed roller in a case that the detected member is positioned in the first position, and wherein the detected member is moved from the first position to the second position by the feed roller being driven and then by moving of the projection portion interfering with the feed roller to a direction of the detecting device so as to project.

10. A sheet feeding apparatus according to claim 9, wherein the feeding unit is provided with a pressing portion configured to press the detected member, wherein the detected member is provided with a first inclined surface pressed by the pressing portion when the detected member is positioned in the first position, and a second inclined surface pressed by the pressing portion when the detected member is positioned in the second position, via a peak portion projecting toward a direction of the pressing portion, and wherein the projecting portion interferes with the feed roller in the peak portion where a surface to be pressed by the pressing portion is switched from the first inclined surface to the second inclined surface by the feed roller being driven.

11. A sheet feeding apparatus according to claim 9, wherein the holding unit is provided with an abutting portion configured to prevent the detected member from moving in the direction of the detecting device by the detected member being abutted when the detected member moves to the second position.

12. An image forming apparatus comprising:

an image forming apparatus configured to perform image formation on a sheet; and feeding apparatus according to claim 1.

13. A sheet feeding apparatus comprising:

a stacking unit provided with a stacking plate on which a sheet is stacked and capable of performing up-and-down operation;

a feeding unit provided with a feed roller configured to feed the sheet, a rotatable supporting member configured to support the feed roller, and a detected member provided on the supporting member;

an opening/closing member being openable and closable to exchange the feeding unit;

a holding unit provided with a detecting device configured to detect the detected member, provided above the stacking unit, and configured to dismountably hold the feeding unit;

a drive unit configured to cause the stacking plate to perform the up-and-down operation; and a control unit configured to control the drive unit, wherein in a timing after detecting that the opening/closing member is opened and closed, the control unit determines that that the feeding unit mounted on the holding unit is not new in a case that the control unit causes the drive unit to raise the stacking plate and the detecting device detects the detected member, and the control unit determines that the feeding unit mounted on the holding unit is new in a case that the control unit causes the drive unit to raise the stacking plate and the detecting device does not detect the detected member, and the control unit causes the drive unit to lower the stacking plate, rotate the feed roller, and then again raise the stacking plate and then the detecting device detects the detected member.

14. A sheet feeding apparatus according to claim 13, wherein the control unit determines that that the feeding unit is not mounted in a case that the control unit causes the drive unit to raise the stacking plate and the detecting device does not detect the detected member, and the control unit causes the drive unit to lower the stacking plate, rotate the feed roller, and then again raise the stacking plate and then the detecting device does not detect the detected member.

* * * * *